US006680712B2

(12) United States Patent
Yamamoto et al.

(10) Patent No.: US 6,680,712 B2
(45) Date of Patent: Jan. 20, 2004

(54) ANTENNA HAVING A CONDUCTIVE CASE WITH AN OPENING

(75) Inventors: Atsushi Yamamoto, Osaka (JP); Hiroshi Iwai, Katano (JP); Koichi Ogawa, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 52 days.

(21) Appl. No.: 10/060,508

(22) Filed: Jan. 30, 2002

(65) Prior Publication Data

US 2002/0135522 A1 Sep. 26, 2002

(30) Foreign Application Priority Data

Jan. 30, 2001 (JP) ..... 2001-022366

(51) Int. Cl.[7] ..... H01Q 1/42; H01Q 1/38
(52) U.S. Cl. ..... 343/789; 343/700 MS
(58) Field of Search ..... 343/700 MS, 784, 343/789, 772, 780; H01Q 1/42, 1/38

(56) References Cited

U.S. PATENT DOCUMENTS 2,431,124 A * 11/1947 Kees et al. ..... 343/789
3,534,376 A * 10/1970 Web ..... 343/789
4,086,598 A * 4/1978 Bogner ..... 343/768
5,457,470 A 10/1995 Hai et al.
5,936,590 A * 8/1999 Funder ..... 343/795
6,320,542 B1 11/2001 Yamamoto et al.

FOREIGN PATENT DOCUMENTS

| | | |
|---|---|---|
| EP | 0 797 268 A2 | 9/1997 |
| EP | 1 033 782 A2 | 9/2000 |
| EP | 1 158 604 A2 | 11/2001 |
| JP | 10-312112 | 11/2000 |

* cited by examiner

*Primary Examiner*—Hoanganh Le
(74) *Attorney, Agent, or Firm*—RatnerPrestia

(57) ABSTRACT

An antenna, has a box conductive case having at least a single opening on an upper part, an internal conductor which is stored in the case, is disposed at a bottom, and is shaped like a letter "コ" which is one of Japanese katakana letters, a letter "u", a letter "U", a cramp, or an arc, and a feeding element which is stored in the conductive case and is connected to a feeding section disposed on the bottom of the conductive case, wherein the internal conductor other than parts disposed on the conductive case is not connected to the case.

26 Claims, 27 Drawing Sheets n: Positive integer
λ: Free space wavelength (λ0: Free space wavelength at frequency f0 )

f0: Center frequency of prototype antenna of the present embodiment

1 λm Loop × 2

1.5λc Dipole

λm: Free space wavelength at frequency fm

λc: Free space wavelength at frequency fc f0: Center frequency f1

Horizontal surface

Vertical surface f2

Horizontal surface

Vertical surface (λ0: Free space wavelength)

f0: Center frequency

ANTENNA HAVING A CONDUCTIVE CASE WITH AN OPENING

DETAILED DESCRIPTION OF THE INVENTION

1. Field of the Invention

The present invention relates to an antenna having bidirectional characteristic

2. Related Art of the Invention

A conventional technique will be discussed in accordance with FIGS. 21 to 24.

FIG. 21 shows an example of an antenna having bidirectional radiation patterns on a horizontal surface, and FIG. 22 shows an example of a prototype antenna. Further, FIG. 23 shows input impedance characteristics of the prototype antenna, and FIG. 24 shows radiating directivity of the prototype antenna.

In FIG. 21, reference number 111 denotes a feeding section, reference numeral 112 denotes an antenna element, reference numeral 113 denotes a cavity, reference numeral 114 denotes a linear conductor, and reference numerals 115 and 116 denote openings. The feeding section 111 is positioned at the center of the bottom of the cavity 113, one of the ends of the antenna element 112 is connected to the feeding section 111 and the other end is electrically connected to the linear conductor 114.

The following configuration is shown as an example: the cavity 113 forms a rectangular parallelepiped symmetric with respect to ZY surface and ZX surface, the two rectangular openings 115 and 116, which are identical in form with the linear conductor 114 being sandwiched therebetween, are disposed on the upper surface of the cavity 113 so as to be symmetric with respect to ZY surface, the feeding section 111 is disposed on the origin of the XY surface, the antenna element 112 is composed of a conductor line perpendicular to XY surface, and the linear conductor 114 and the antenna element 112 are mechanically and electrically connected to each other by soldering and the like.

Here, a space surrounded by the cavity 113 is referred to as the interior of the antenna, and a space opposite to the interior of the antenna relative to the cavity 113 is referred to as the exterior of the antenna.

FIG. 22 shows the prototype antenna. As an example, the bottom of the cavity 113 is a square having a side of $0.835\times\lambda 0$ ($\lambda 0$:free space wavelength) and a height of $0.0835\times\lambda 0$ relative to a free space wavelength $\lambda 0$ of a center frequency f0. The linear conductor 114 is disposed on ZY surface in parallel with Y axis with a length of $0.835\times\lambda 0$, and both ends of the linear conductor 114 are electrically connected to the sides of the cavity 113. And the two openings 115 and 116 are rectangular, each having a side of $0.209\times\lambda 0$ in parallel with X axis and a side of $0.835\times\lambda 0$ in parallel with Y axis. The two openings 115 and 116 are disposed so as to be adjacent to each other with the linear conductor 114 being sandwiched therebetween at the center of the ceiling of the antenna. The above-mentioned antenna has a symmetric structure with respect to ZX surface and ZY surface. At this moment, the antenna element 112 is composed of a conductor line and is $0.0835\times\lambda 0$ in length. The protruding end of the antenna element 112 is electrically connected to the linear conductor 114 on the ceiling of the antenna.

FIG. 23 shows VSWR (Voltage Standing Wave Ratio) characteristics relative to a 50-ohm feeding line regarding input impedance characteristics of the prototype antenna.

The lateral axis is standardized at a center frequency of f0). f1 of FIG. 23 is a minimum frequency where VSWR satisfies 2 or less. f2 is a maximum frequency where VSWR satisfies 2 or less. As shown in FIG. 23, a band where VSWR is 2 or less accounts for 18.2% in a fractional bandwidth ((f2−f1)/f0). It is found that fine impedance characteristics are shown over a broad band with small reflection loss.

FIG. 24 shows as an example the radiating directivity at a center frequency to regarding the antenna having the above configuration. The radiating directivity is marked in 10 dB, and the unit is dBi, which is based on radiant power of a point wave source. As shown in FIG. 24, the above-mentioned antenna suppresses radiation of radio waves in Y direction and obtains bidirectional radiation patterns in X direction. Therefore, the above example shows excellent characteristics in a narrow interior space such as a corridor.

Moreover, the antenna element 112 is $0.0835\times\lambda 0$ in height and is shorter than a typical ¼ wavelength antenna element. As described above, according to the configuration of the above-mentioned antenna, the antenna element 112 can be smaller in height. When the antenna cannot be embedded into the ceiling of a room, it is possible to realize an antenna having a preferable appearance with a small protruding part being out of a person's sight on the ceiling.

In addition, in the above-mentioned conventional technique, the antenna is symmetric with respect to ZY surface and ZX surface. In this case, the directivity of radiant radio waves from the antenna is symmetric with respect to ZY surface and ZX surface.

As described above, it is possible to realize a small and excellent antenna that has desired bidirectional radiation patterns with a simple configuration.

However, in the conventional example of FIG. 21 is disadvantageous as follows: although the above-described configuration can achieve broadband impedance characteristics, it is not possible to have fine impedance characteristics and bidirectional radiation patterns on a broader band. For this reason, when a frequency bandwidth used by a plurality of applications is a broad band, a plurality of antennas is necessary.

However, a wider space is necessary for setting a plurality of antennas, and a plurality of signal transmission lines is further required, which is conspicuous and is undesirable in appearance. Also, the cost is increased.

Therefore, in order to achieve preferable appearance with low cost, when a frequency bandwidth used by a plurality of applications is a broad band, the configuration of the conventional example is inevitably unsuitable because it cannot obtain bidirectional radiation patterns over a broad band.

When a frequency bandwidth used by a plurality of applications is a broad band, it is necessary to obtain fine impedance characteristics and bidirectional radiation patterns at frequencies over a band broader than that of the conventional antenna.

SUMMARY OF THE INVENTION

Hence, in view of the above-mentioned problem, the present invention aims to provide an antenna which is small in size particularly on the upper side and obtains bidirectional radiation patterns over a broad band.

One aspect of the present invention is an antenna, comprising:

a box conductive case having at least a single opening on an upper part, an internal conductor which is stored in said case, is disposed at a bottom, and is shaped like a letter "⊐"

which is one of Japanese katakana letters, a letter "u", a letter "U", a cramp, a horseshoe or an arc, and a feeding element which is stored in said conductive case and is connected to a feeding section disposed on said bottom of said conductive case, wherein said internal conductor other than parts disposed on said conductive case is not connected to said case.

Another aspect of the present invention is the antenna, wherein said feeding element is connected to a ceiling of said internal conductor.

Still another aspect of the present invention is the antenna, further comprising a gap for electrically opening said feeding element from a feeding section of said internal conductor, said gap being provided between said feeding element and a ceiling of said internal conductor.

Yet still another aspect of the present invention is the antenna, further comprising at least one or more matching conductors being electrically connected to said conductive case.

Still yet another aspect of the present invention is the antenna, wherein at least one or more of said matching conductors are electrically connected to said feeding element.

A further aspect of the present invention is the antenna, wherein at least one or more of said matching conductors are electrically connected to said internal conductor.

A still further aspect of the present invention is the antenna, wherein a space including said feeding element is entirely or partially filled with a dielectric, said space being surrounded by said conductive case.

A yet further aspect of the present invention is the antenna, wherein said dielectric is a dielectric substrate, said conductive case includes a metallic foil pattern attached on said dielectric substrate and/or a via provided on said dielectric substrate, said internal conductor has a ceiling including said metallic foil pattern attached on said dielectric substrate, and said internal conductor has a side including said via provided on said dielectric substrate.

A still yet further aspect of the present invention is the antenna, further comprising opening control means of adjusting a size of said opening.

An additional aspect of the present invention is the antenna, further comprising ceiling conductor adjusting means of adjusting a ceiling size of said internal conductor.

A still additional aspect of the present invention is the antenna, wherein said bottom of said conductive case is circular.

A yet additional aspect of the present invention is the antenna, wherein said bottom of said conductive case is a rectangular parallelepiped.

A still yet additional aspect or the present invention is the antenna, wherein when said internal conductor is shaped like a letter "コ" which is one of Japanese katakana letters, a length of a ceiling of said internal conductor, in a direction parallel to a direction from a part to the other part that are in contact with said conductive case is shorter than a wavelength of the highest frequency in a frequency band having better characteristics than predetermined characteristics.

A supplementary aspect of the present invention is the antenna according to 1st invention, wherein when using rectangular coordinates having an origin placed at a center of said conductive case, X axis and Y axis that are placed on said bottom of said conductive case, and Z axis intersecting said bottom, said conductive case is symmetric with respect to ZX surface and ZY surface of said rectangular coordinates, and said feeding section is placed on Y axis of said rectangular coordinates.

A still supplementary aspect of the present invention is the antenna, wherein said internal conductor has a center at said origin.

A yet supplementary aspect of the present invention is the antenna, wherein said internal conductor is symmetric with respect to said ZX surface and ZY surface.

A still yet supplementary aspect of the present invention is the antenna, wherein said X axis is along a direction of radiating an electromagnetic wave.

One aspect of the present invention is the antenna according, further comprising at least one or more directivity control conductors.

Another aspect of the present invention is the antenna, when using rectangular coordinates having an origin placed at the center of said conductive case, X axis and Y axis that are placed on said bottom of said conductive case, and Z axis intersecting said bottom, said directivity control conductors are placed so as to be symmetric with respect to ZY surface of said rectangular coordinates.

Still another aspect of the present invention is the antenna, wherein said directivity control conductors are placed so as to be symmetric with respect to ZX surface of said rectangular coordinates.

Yet still another aspect of the present invention is the antenna, wherein at least one of said directivity control conductors is connected to said conductive case.

Still yet another aspect of the present invention is the antenna, wherein a resonance frequency of said internal conductor, a resonance frequency of said conductive case on a surface in parallel with said internal conductor and perpendicular to said bottom of said conductive case, and a resonance frequency of said conductive case on a surface perpendicular to said internal conductor and said bottom of said conductive case are different from one another.

A further aspect of the present invention is the antenna, wherein said internal conductor is connected to said conductive case via a capacitor.

A still further aspect of the present invention is the antenna, wherein said internal conductor is connected to said conductive case via a coil.

DESCRIPTION OF SYMBOLS

Figure 1:
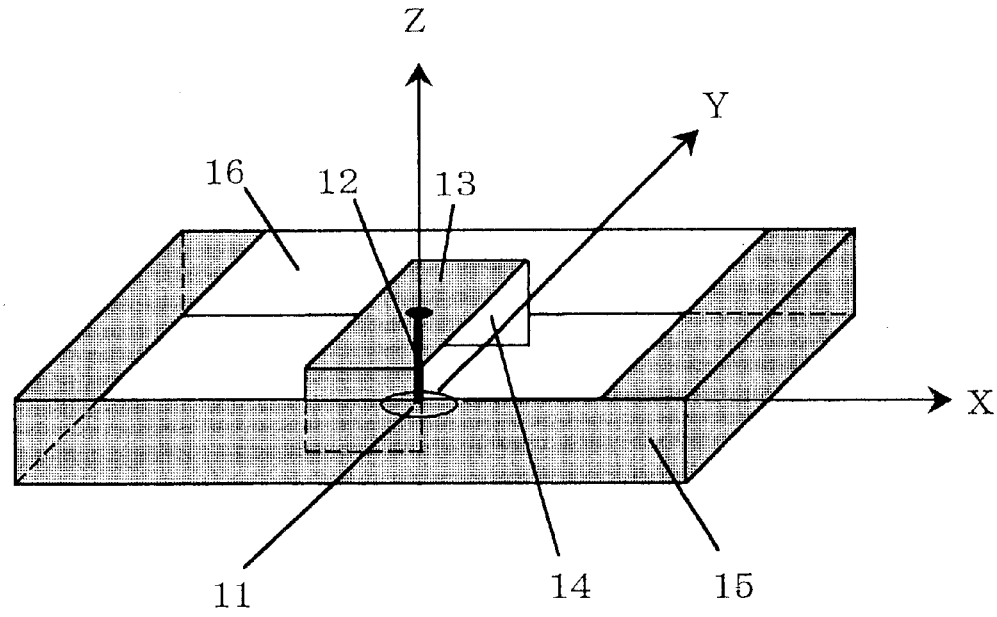
FIG. 1 is a diagram showing an example of the configuration of an antenna according to Embodiment 1 of the present invention.

11 . . . Feeding section
12 . . . Antenna element
13 . . . Ceiling conductor
14 . . . Side conductor
15 . . . Cavity
16 . . . Opening
17 . . . Opening controller
18, 19 . . . Ceiling conductor controller
21, 22 . . . Matching conductor
31 . . . Dielectric
32 . . . Via
111 . . . Feeding section
112 . . . Antenna element
113 . . . Cavity
114 . . . Linear conductor
115, 116 . . . Opening

Embodiment

The following will discuss the embodiments of the present invention in accordance with the accompanied drawings.

Embodiment (1)

Referring to FIG. 1, firstly Embodiment 1 of the present invention will be discussed.

FIG. 1 shows the configuration of an antenna according to Embodiment 1 of the present invention.

In FIG. 1, reference numeral 11 denotes a feeding section, reference numeral 12 denotes an antenna element, reference numeral 13 denotes a ceiling conductor, reference numeral 14 denotes side conductors, reference numeral 15 denotes a cavity, and reference numeral 16 denotes an opening. The bottom of the cavity 15 is on XY surface, the feeding section 11 is positioned on a surface of the cavity 15, and the antenna element 12 is connected to the feeding section 11. The side conductors 14 and the ceiling conductor 13 are electrically connected to each other, and the side conductors 14 are electrically connected to the cavity 15.

As an example, the following configuration is shown: the cavity 15 forms a rectangular parallelepiped symmetric with respect to ZY surface and ZX surface, the feeding section 11 is disposed on the origin of the XY surface, the ceiling conductor 13 and the side conductors 14 are rectangular and are disposed so as to be symmetric with respect to ZY surface and ZX surface, and the antenna element 12 is composed of a conductor line perpendicular to XY surface. Here, a radiating direction is along X axis.

Next, an operating principle of radiation will be discussed in accordance with FIG. 2.

In the antenna of the present embodiment, excitation of radio waves is performed by the antenna element 12. A "コ" shaped conductor ("コ" is one of Japanese Katakana letters) composed of the ceiling conductor 13 and the side conductors 14 achieves bidirectional radiation patterns.

Figure 2:
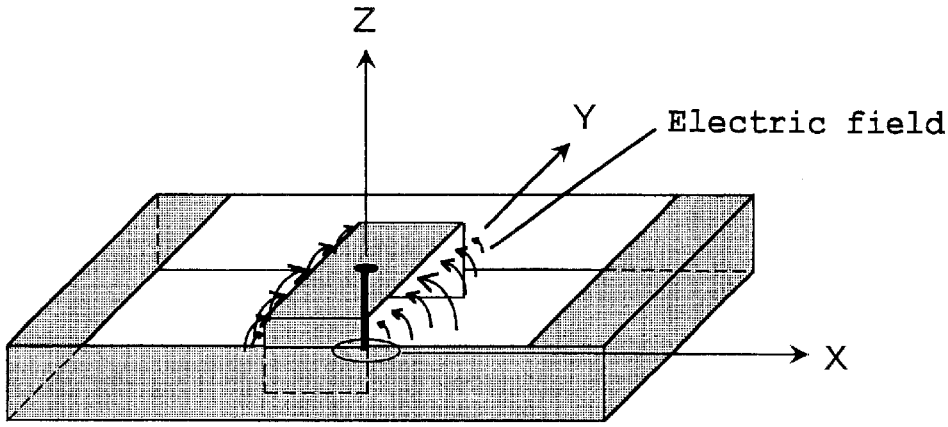
FIG. 2(A) is a diagram showing an operating principle of the configuration example of the antenna according to Embodiment 1 of the present invention, and directions of electric fields applied by an antenna element 12 between a ceiling conductor 13 and the bottom of the cavity 15.
FIG. 2(B) is a diagram showing an operating principle of the configuration example of the antenna according to Embodiment 1 of the present invention and the electric fields of FIG. 2(A) replaced with magnetic currents.
Figure 2:
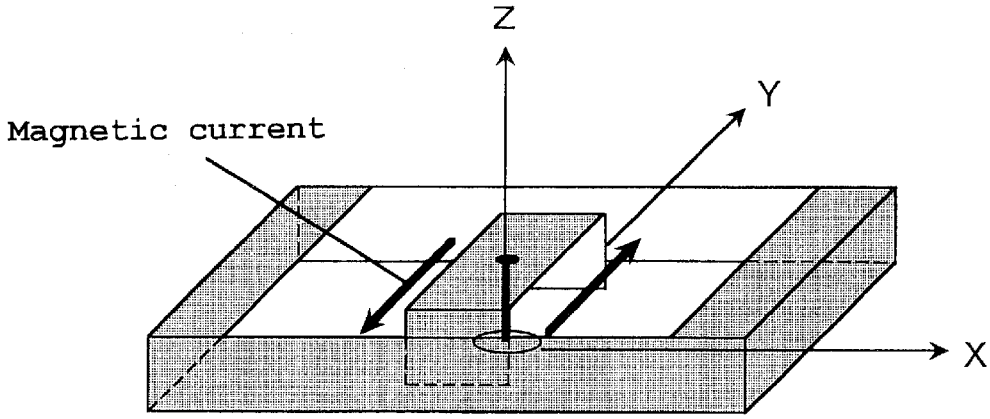
Figure 3:
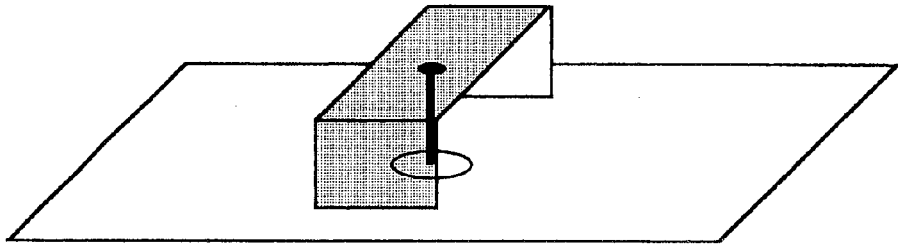
FIG. 3(A) is a diagram showing an operating principle of the configuration example of the antenna according to Embodiment 1 of the present invention, and an M-type antenna composed of the antenna element 12, the ceiling conductor 13, side conductors 14, and the bottom of the cavity 15.
FIG. 3(B) is a diagram showing an operating principle of the configuration example of the antenna according to Embodiment 1 of the present invention, and an antenna composed of the cavity 15.
Figure 3:
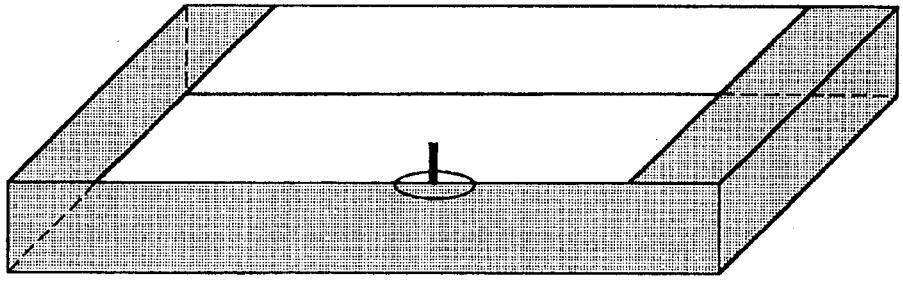

The following will discuss an operating principle for achieving bidirectional radiation patterns in accordance with FIG. 2. As shown in FIG. 2(A), the antenna element 12 causes the directions of electric fields between the ceiling conductor 13 and the bottom of the cavity 15 to be opposite to each other relative to ZY surface.

When the electric fields of the above explanation are replaced with magnetic currents, as shown in FIG. 2(B), the electric fields can be replaced with two linear magnetic current sources, which are in parallel with Y axis and are opposite in direction with equal amplitude. Namely, radiation of radio waves is regarded as radiation from an array of the above two magnetic current sources.

In general, in an antenna array, a direction of strengthening radiated radio waves depends upon an array factor, which is determined by a phase difference of current fed from an antenna element and an interval between antenna elements. Radiated radio waves of the entire antenna array are represented as the product of the above array factor and a radiation pattern of a single antenna element.

By replacing the radiation pattern of a single antenna element with a radiation pattern of a single linear magnetic current source, the radiation pattern of the antenna of the present embodiment can be obtained approximately.

To be specific, regarding radio waves radiated from the above two magnetic current sources, the magnetic current sources are disposed so as to be symmetrical with respect to ZY surface. Thus, the radio waves are cancelled because they are opposite in phase with equal amplitude on the ZY surface. In other words, no radio wave is radiated to ZY surface.

Further, ZX surface has a direction of equalizing phases of radio waves radiated from two magnetic current sources, and radio waves are strengthened in this direction. For example, when a distance between magnetic current sources is a ½ wavelength in a free space, phases are equalized in a direction of X axis. Thus, radiated radio waves are strengthened in +X direction and −X direction.

In order to provide the antenna with bidirectional radiation patterns, the ceiling conductor 13 needs to be shorter along Y axis than a wavelength of the upper limit frequency of a frequency band having better characteristics than predetermined characteristics. In order to have better bidirectional radiation patterns, it is desirable that the ceiling conductor 13 be substantially equal in length along Y axis to a half of the above wavelength. For example, as a frequency band having better characteristics than predetermined characteristics, in the case where an operating band belongs to a frequency band having a VSWR at 2 or less, the ceiling conductor 13 needs to be shorter along Y axis than a wavelength of the upper limit frequency of the frequency band having a VSWR at 2 or less. In order to achieve better bidirectional radiation patterns, it is desirable that the ceiling conductor 13 be substantially equal in length along Y axis to a half of the above wavelength.

Namely, according to the configuration of the present embodiment, a single antenna element can obtain the effect of an antenna array, thereby achieving bidirectional radiation patterns.

Referring to FIGS. 3 to 6, impedance characteristics in a broader band will be discussed.

In the present embodiment, resonance of the antenna is the sum of two resonances of an M-type antenna, which is composed of the antenna element 12, the ceiling conductor 13, the side conductor 14, and the bottom of the cavity 15 of FIG. 3(A), and the cavity 15 of FIG. 3(B).

Figure 4:
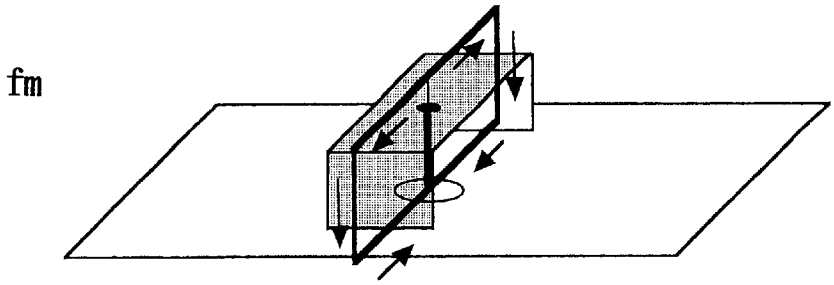
FIG. 4(A) is a diagram showing an operating principle of the configuration example of the antenna according to Embodiment 1 of the present invention, and current applied to the M-type antenna.
FIG. 4(B) is a diagram showing an operating principle of the configuration example of the antenna according to Embodiment 1 of the present invention, and current applied to the cavity.
FIG. 4(C) is a diagram showing an operating principle of the configuration example of the antenna according to Embodiment 1 of the present invention, and current applied to the cavity.
Figure 4:
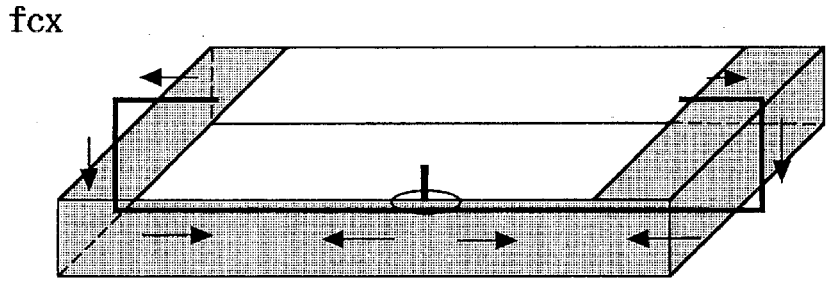
Figure 4:
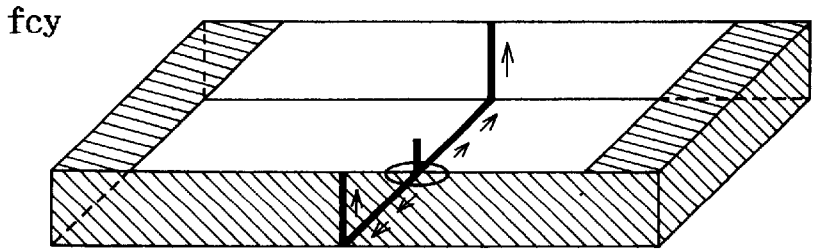
Figure 5:
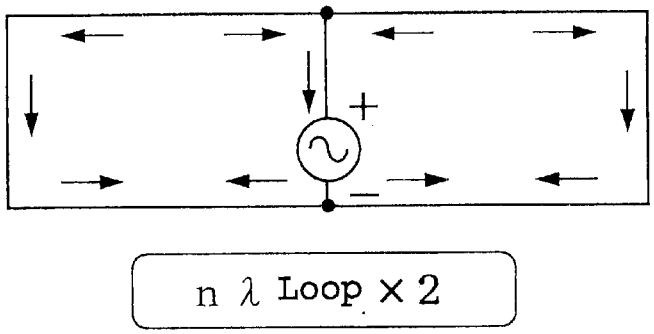
FIG. 5(A) is a diagram showing an operating principle of the configuration example of the antenna according to Embodiment 1 of the present invention, and a resonant mode of the M-type antenna.
FIG. 5(B) is a diagram showing an operating principle of the configuration example of the antenna according to Embodiment 1 of the present invention, and a resonant mode of the cavity.
FIG. 5(C) is a diagram showing an operation principle of the configuration example of the antenna according to Embodiment 1 of the present invention, and a resonant mode of the cavity.
Figure 5:
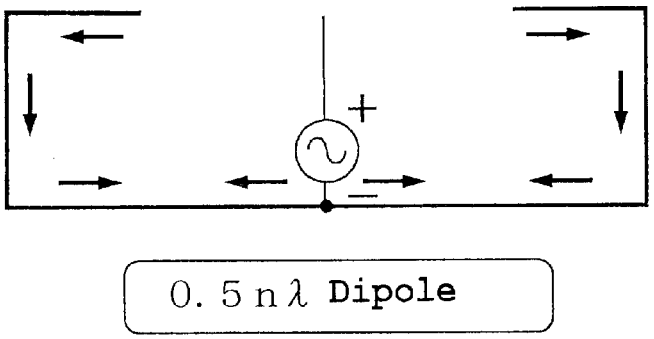
Figure 5:
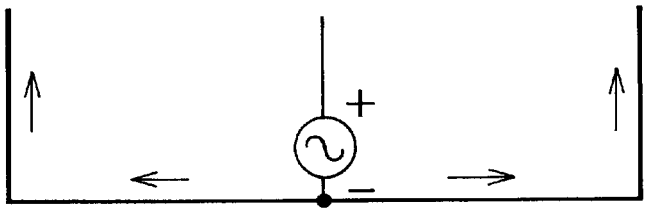

FIGS. 4(A), 4(B), and 4(C) respectively show currents applied to the M-type antenna and the cavity 15. According to FIG. 4, the resonant mode of the M-type antenna can be expressed by two loops as shown in FIG. 5(A). The resonant mode of the cavity can be expressed by two intersecting dipoles as shown in FIGS. 5(B) and 5(C). Namely, the resonant mode of FIG. 5(B) is a resonant mode of the cavity 15 on a surface which is perpendicular to the ceiling conductor 13 and the bottom of the cavity 15. FIG. 5(C) is a resonant mode of the cavity 15 on a surface which is in parallel with the ceiling conductor 13 and is perpendicular to the bottom of the cavity 15.

In the case of a loop, the condition of resonance is that phases are uniform after one cycle. The loop has a length of n wavelengths (n: positive integer). Meanwhile, in the case of a dipole, the condition of resonance is that current applied to the dipole is 0 at the end and a standing wave is maximum on a feeding section. The dipole is 0.5·n wavelengths (n: positive integer) in length.

At this moment, since a difference is made in resonance frequency between the M-type antenna and the cavity, the antenna of the present embodiment can obtain broadband impedance characteristics.

Figure 6:
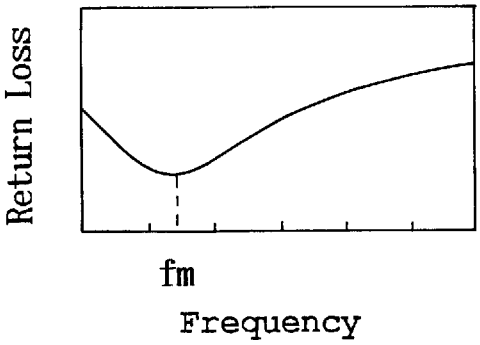
FIG. 6(A) is a diagram showing an operating principle of the configuration example of the antenna according to Embodiment 1 of the present invention, and frequency characteristics of reflection loss of the M-type antenna (loop)
FIG. 6(B) is a diagram showing an operating principle of the configuration example of the antenna according to Embodiment 1 of the present invention, and frequency characteristics of reflection loss of the cavity (dipole)
FIG. 6(C) is a diagram showing an operating principle of the configuration example of the antenna according to Embodiment 1 of the present invention, and frequency characteristics of refection loss of the cavity (dipole).
FIG. 6(D) is a diagram showing an operating principle of the configuration example of the antenna according to Embodiment 1 of the present invention, and frequency characteristics of reflection loss regarding the antenna according to the present embodiment.
Figure 6:
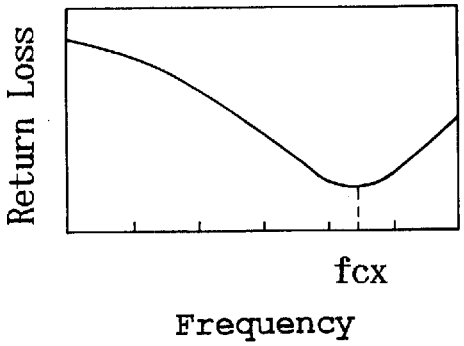
Figure 6:
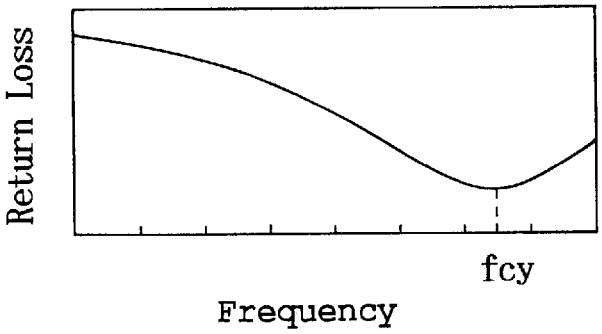
Figure 6:
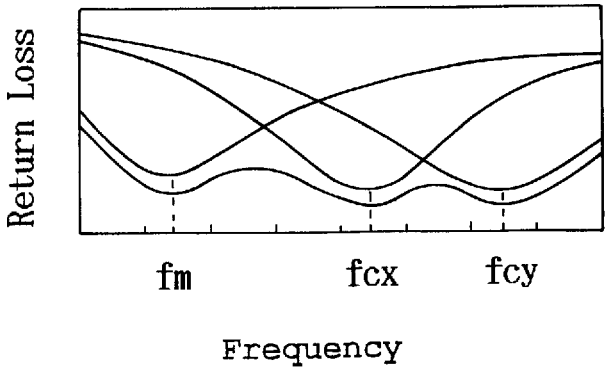

The above state will be described using frequency characteristics of reflection loss that are shown in FIG. 6. FIG. 6(A) shows resonant characteristics of the M-type antenna (loop). It is found that resonance occurs at a frequency fm. FIG. 6(B) shows resonant characteristics in a resonant mode of the cavity 15 on a surface which is perpendicular to the ceiling conductor 13 of the cavity (dipole) and is perpendicular to the bottom of the cavity 15. It is found that resonance occurs at a frequency fcx. FIG. 6(C) shows resonant characteristics in a resonant mode of the cavity 15 on a surface which is in parallel with the ceiling conductor 13 of the cavity (dipole) and is perpendicular to the bottom of the cavity 15. It is found that resonance occurs at a frequency fcy.

Description will be made by taking the following state as an example: a resonance frequency fm of the M-type antenna is somewhat lower than fcx of resonance frequencies of the cavity, and fcx of resonance frequencies of the cavity is somewhat lower than fcy. The antenna resonant characteristics of the present embodiment are determined as superimposition of the resonance of the M-type antenna and the resonance of the cavity. Thus, broadband resonant characteristics are obtained as indicated by solid lines of FIG. 6(D). As described above, the antenna of the present embodiment is an antenna which is small in reflection loss with fine impedance characteristics over a broad band.

As mentioned above, the antenna of the present embodiment is an excellent antenna achieving separate designs of the M-type antenna and the cavity, an increased degree of freedom in design, and a broader band of the antenna.

Besides, the present embodiment described that a resonance frequency fm of the M-type antenna is somewhat lower than fcx of resonance frequencies of the cavity, and fcx of resonance frequencies of the cavity is somewhat lower than fcy. The present invention is not limited to the above case as long as at least two or more of a resonance frequency fm of the M-type antenna, a resonance frequency fcx of the cavity, and a resonance frequency fcy of the cavity are different from each other.

Figure 7:
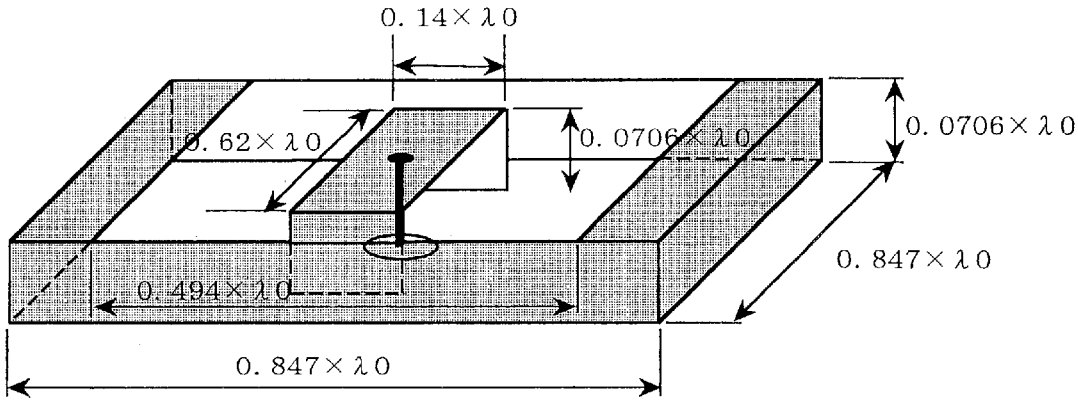
FIG. 7 is a diagram showing an example of a prototype of the antenna according to Embodiment 1 of the present invention.

Next, FIG. 7 shows an actual prototype of the antenna.

It is assumed that a free space wavelength is λ0 when a center frequency is at f0. As an example, characteristics will be shown when the cavity 15 is a square of 0.847×λ0 and is 0.0706×λ0 in height, the ceiling conductor 13 is a rectangle where a side in parallel with X axis is 0.14×λ0 in length and a side in parallel with Y axis is 0.62×λ0 in length, the side conductor 14 is 0.14×λ0 in length along X axis and is 0.0706×λ0 in height, which is equal to that of the cavity 15, and the antenna of the present embodiment has a symmetric structure with respect to ZX surface and ZY surface. In this case, the antenna element 12 is a conductor line having a diameter of 0.013×λ0 with an element length of 0.0706×λ0. The antenna element 12 is connected to the feeding section 11 positioned at the center of the bottom of the cavity 15.

Figure 8:
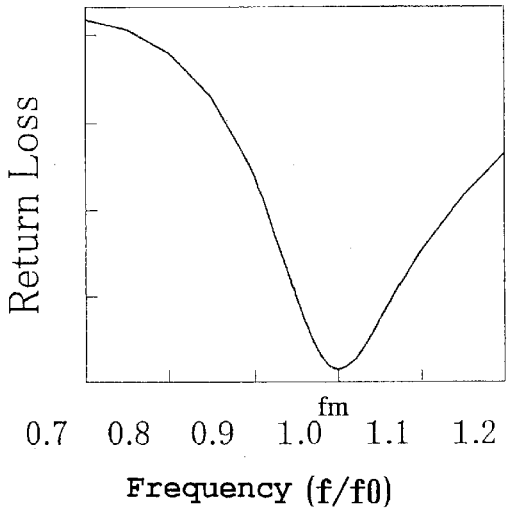
FIG. 8(A) is a diagram showing an operating principle of the configuration example of the prototype antenna according to Embodiment 1 of the present invention, and frequency characteristics of reflection loss regarding the M-type antenna in the prototype.
FIG. 8(B) is a diagram showing an operating principle of the configuration example of the prototype antenna according to Embodiment 1 of the present invention, and frequency characteristics of reflection loss regarding the cavity in the prototype.
FIG. 8(C) is a diagram showing an operating principle of the configuration example of the prototype antenna according to Embodiment 1 of the present invention, and VSWR characteristics of the M-type antenna in the prototype.
Figure 8:
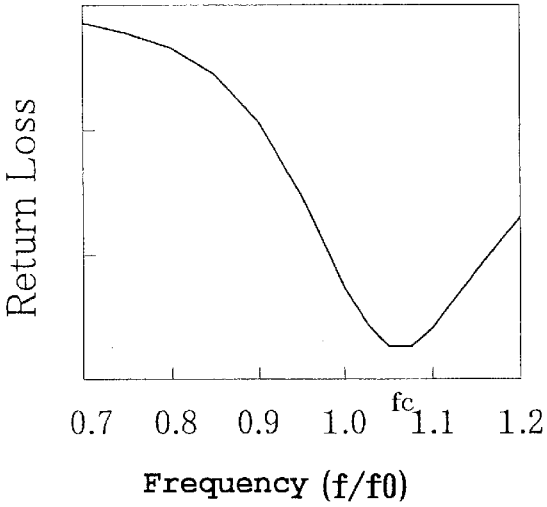
Figure 8:
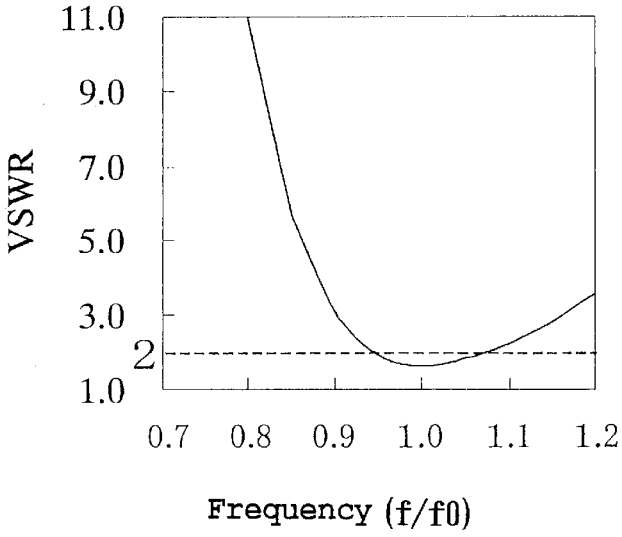

FIGS. 8(A) and 8(B) respectively show resonant characteristics of the M-type antenna and the cavity in the prototype of the present embodiment. Additionally, FIG. 8(C) shows VSWR (Voltage Standing Wave Ratio) characteristics of the M-type antenna. Here, FIG. 8(C) shows that as for the M-type antenna, a bandwidth having a VSWR of 2 or less accounts for 12.2% in a fractional bandwidth. In all of the drawings in FIG. 8, lateral axes are expressed by a frequency standardized by a center frequency of the prototype antenna of the present embodiment.

Figure 9:
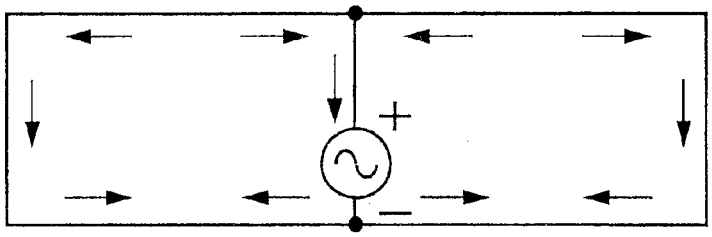
FIG. 9(A) is a diagram showing an operating principle of the configuration example of the prototype antenna according to Embodiment 1 of the present invention, and a resonant mode of the M-type antenna in the prototype.
FIG. 9(B) is a diagram showing an operating principle of the configuration example of the prototype antenna according to Embodiment 1 of the present invention, and a resonant mode of the cavity in the prototype.
Figure 9:
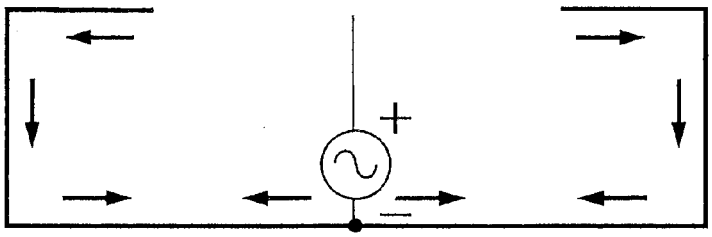

As shown in FIGS. 8(A) and 8(B), the cavity is higher than the M-type antenna in resonance frequency. At this moment, when expression is made using the resonant mode of FIG. 5, the M-type antenna can be expressed by two 1-λm loops and the cavity can be expressed by a 1.5-λc dipole based on the resonance frequencies and the configuration. Here, λm and λc respectively represent free space wavelengths at frequencies of fm and fc. FIGS. 9(A) and 9(B) show the resonant modes of the M-type antenna and the cavity.

Figure 10:
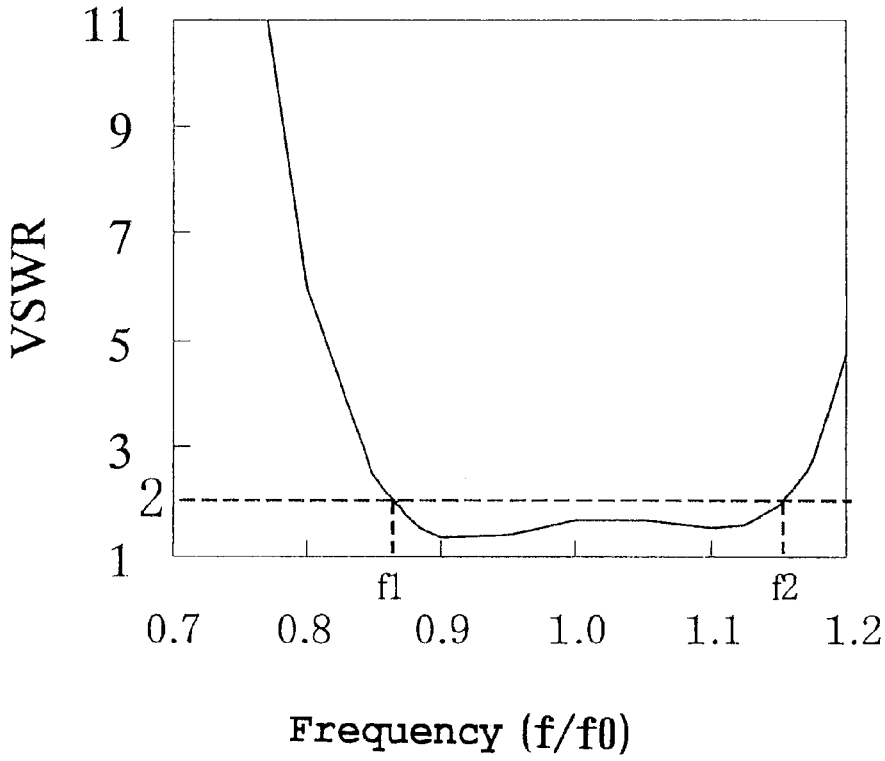
FIG. 10 is a diagram showing an example of impedance characteristics of the prototype antenna according to Embodiment 1 of the present invention.

FIG. 10 shows VSWR characteristics regarding a 50-ohm feeding line of an input impedance of the antenna according to the present embodiment. In FIG. 10, f1 denotes a minimum frequency for satisfying a VSWR of 2 or less, f2 denotes a maximum frequency for satisfying a VSWR of 2 or less, and f0 denotes a center frequency.

In FIG. 10, a bandwidth having a VSWR at 2 or less accounts for 27.1% in a fractional bandwidth ((f2−f1)/f0). It is found that an antenna is realized with low loss over a quite broad band. A bandwidth of the antenna increases proportionately with a volume of the antenna. Thus, when comparison is made in volume with a conventional antenna, the following equation 1 is established.

(prototype antenna of the present embodiment)/(conventional antenna)=0.87 [Equation 1]

Namely, as shown in equation 1, the result is 0.87, which indicates a reduction in volume by 13%. Meanwhile, a fractional bandwidth increases as the following equation 2.

(prototype antenna of the present embodiment)/(conventional antenna)=1.49 [Equation 2]

Namely, as shown in equation 2, a fractional bandwidth increases by 1.49 times, that is, an increase by 49%. Therefore, the prototype of the present embodiment increases in fractional bandwidth by 56% in view of the above reduction in volume.

As described above, the prototype antenna of the present embodiment can achieve a broader band of impedance characteristics by 56% as compared with the conventional antenna.

Figure 11:
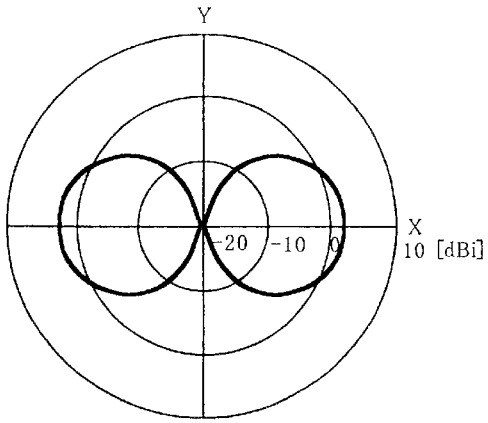
FIG. 11(A) is a diagram showing an example of radiating directivity of the antenna prototype according to Embodiment 1 of the present invention, and radiating characteristics at FIG. 11(B) is a diagram showing an example of radiating directivity of the antenna prototype according to Embodiment 1 of the present invention, and radiating characteristics at f2.
Figure 11:
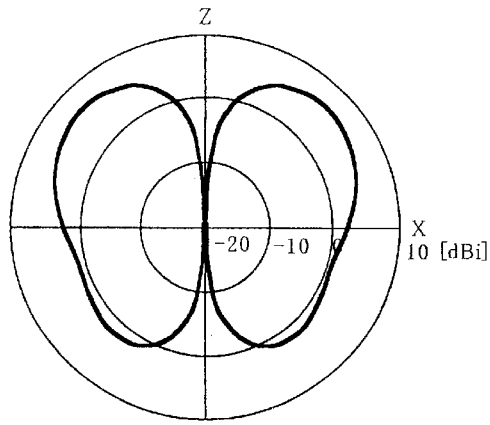
Figure 11:
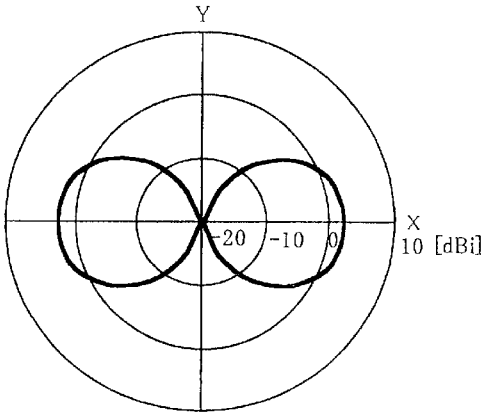
Figure 11:
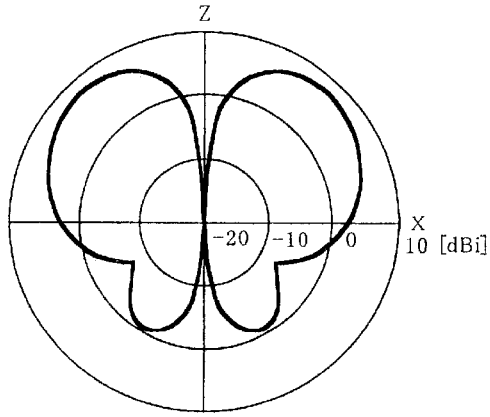

FIG. 11(A) shows radiating characteristics at f1. Further, FIG. 11(B) shows radiating characteristics at f2. FIGS. 11(A) and 11(B) show that bidirectional radiation patterns can be substantially identical to a horizontal surface at frequencies f1 and f2. Thus, it is understood that the antenna of the present embodiment has low-loss characteristics over a broad band and has bidirectional radiation patterns over a broad band regarding radiating characteristics.

Further, regarding the prototype antenna of the present embodiment as well, the antenna element has a height of 0.0706×λ0 which is lower than a typical ¼ wavelength antenna element. This state is equal to a state in which capacitive combination appears between the ceiling conductor 13 and the cavity 15 of the antenna and a protruding end of the antenna element 12 has a capacitive load. The antenna element 12 is lower in height. The prototype antenna is reduced to 84.6% in height from the conventional antenna, thereby achieving a thinner antenna by about 15%.

In this manner, impedance characteristics are achieved with low loss in a broader band without degradation in characteristics of the conventional antenna.

As the above-mentioned prototype, an antenna was shown, which has impedance characteristics and bidirectional radiation patterns over a broad band while being small and thin. For example, when an application requires extremely small reflection loss, it is also possible to design such that quite small reflection loss is obtained in a desired frequency band by sacrificing a frequency bandwidth of impedance.

In the case of such a design, in order to attain the object, it is necessary to find the most suitable combination of various structural parameters such as a size and height of the cavity 15, a size of the opening 16, a size of the ceiling conductor 13, and a height of the side conductor 14.

Moreover, in the above embodiment and prototype, the antenna of the present embodiment is symmetric with respect to ZY surface and ZX surface. In this case, the directivity of radiated radio waves from the antenna is symmetric with respect to ZY surface and ZX surface.

When the center of the ceiling conductor 13 is shifted from the origin or when the ceiling conductor 13 and the side conductors 14 are not symmetric with respect to ZX surface and ZY surface, a direction having the strongest directivity is shifted from X axis to Y axis accordingly. Such an antenna is applicable in some spaces for setting the antenna.

As described above, according to the present embodiment, it is possible to achieve a small antenna which has low-loss characteristics over a broad band with a simple configuration and has bidirectional radiation patterns over a broad band regarding radiating characteristics.

In addition, as an example, the present embodiment described the antenna symmetric with respect to ZY surface and ZX surface. The present invention is not always limited to the antenna configured thus. For example, in order to obtain desired radiating directivity or input impedance characteristics, the antenna may be symmetric only with respect to ZY surface or may not be symmetric with respect to ZY surface and ZX surface. Further, only the opening 16 may be symmetric with respect to ZY surface or ZY surface and ZX surface. Also, only the cavity 15 may be symmetric with respect to ZY surface or ZY surface and ZX surface. Besides, only the ceiling conductor 13 may be symmetric with respect to ZY surface or ZY surface and ZX surface. Further, only the side conductors 14 may be symmetric with respect to ZY surface or ZY surface and ZX surface. Also, the above members maybe combined. Such a configuration can achieve an antenna having radiating directivity being the most suitable for a radiated space.

Additionally, as an example, the present embodiment discussed the antenna having a single opening 16. The present invention is not always limited to the antenna configured thus. For example, in order to obtain desired radiating directivity or input impedance characteristics, two or more openings 16 may be provided.

Besides, as an example, the present embodiment discussed the antenna having the rectangular opening 16. The present invention is not always limited to the antenna configured thus. For example, in order to obtain desired radiating directivity or input impedance characteristics, the opening 16 may be formed into a circle, a square, a polygon, a semicircle, combined shapes thereof, a ring, or other shapes. When the opening 16 is a circle, an ellipse, or a curved surface, regarding radiating directivity, the diffraction effect is reduced at the corners because the antenna conductor has fewer corners, thereby reducing cross polarization conversion loss of radio waves from the antenna.

In addition, the present embodiment discussed the antenna in which the opening 16 is disposed on the ceiling of the cavity 15. The present invention is not always limited to the antenna configured thus. For example, in addition to the opening 16 disposed on the ceiling of the cavity 15, in order to obtain desired radiating directivity or input impedance characteristics, an opening may be provided on the side of the cavity 15.

Also, the present embodiment discussed the antenna in which the opening 16 is disposed on a part of the ceiling of the cavity 15. The present invention is not always limited to the antenna configured thus. For example, the ceiling of the cavity 15 may be entirely opened and may be entirely used as an opening 15.

Figure 12:
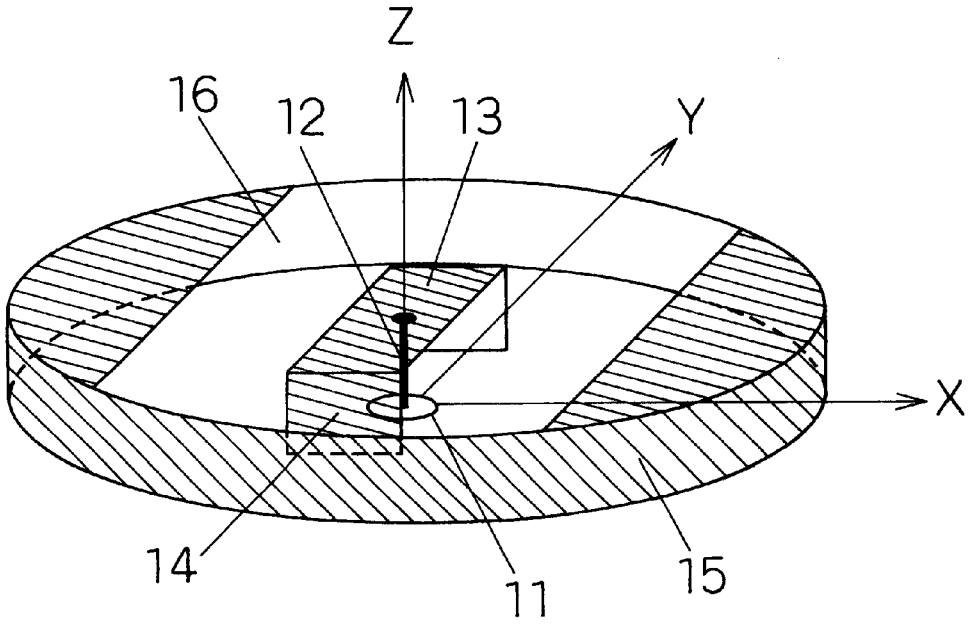
FIG. 12 is a diagram showing an example of the configuration of an antenna according to Embodiments 1, 2, and 3 of the present invention.

Further, the present embodiment discussed the antenna in which the bottom of the cavity 15 is a square. The present invention is not always limited to the antenna configured thus. For example, in order to obtain desired radiating directivity or input impedance characteristics, the bottom of the cavity 15 may be formed into other polygons, a semicircle, combined shapes thereof, or other shapes. Moreover, the bottom of the cavity 15 may be a circle, an ellipse, a curved surface, or other shapes. Thus, regarding radiating directivity, the diffraction effect is reduced on corners because the antenna conductor has fewer corners, thereby reducing cross polarization conversion loss of radio waves from the antenna. Further, when the antenna is set on a ceiling and the like, it has been desired that the shape of the antenna match with the squares of the ceiling or the shape of a room such that the antenna is inconspicuous. However, when the antenna is formed into a rectangular or other polygons, a direction of setting the antenna is limited because the squares of the ceiling and the shape of the room can not be changed. Therefore, in the case where the cavity 15 has a circular bottom, particularly in the case where the antenna has a circular bottom, when the antenna is set on the ceiling, the antenna can be set without considering the squares of the ceiling or the shape of the room. As an example, FIG. 12 shows a configuration in which the cavity 15 is cylindrical. Further, when the antenna has a circular bottom, the antenna can be rotated to change a setting direction. Hence, a direction of radiating radio waves can be adjusted, thereby achieving radiating characteristics being the most suitable for the setting position of the antenna.

Also, as an example, the present embodiment discussed the antenna in which the ceiling conductor 13 is rectangular. The present invention is not always limited to the antenna configured thus. For example, in order to obtain desired radiating directivity or input impedance characteristics, the ceiling conductor 13 may be formed into other polygons, a semicircle, combined shapes thereof, a linear shape, or other shapes. Further, the ceiling conductor 13 may be formed into a circle, an ellipse, a curved surface, or other shapes. Therefore, regarding radiating directivity, the diffraction effect on corners is reduced because the antenna conductor has fewer corners, thereby reducing cross polarization conversion loss of radio waves from the antenna.

Figure 25:
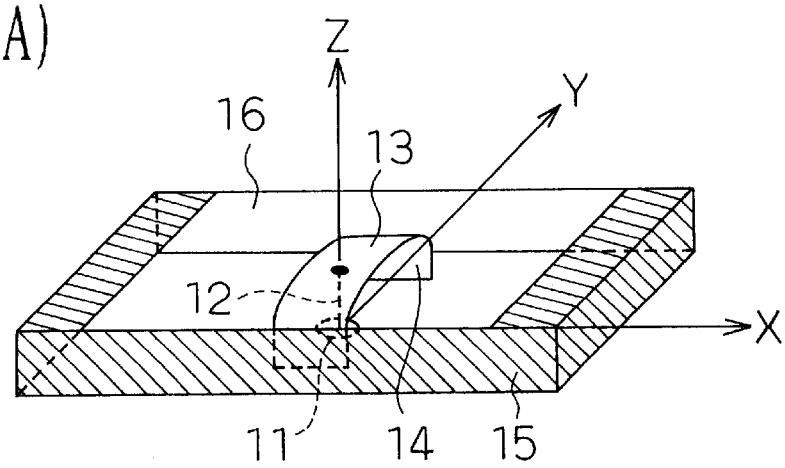
FIG. 25(A) is a diagram showing an example of an antenna in which the ceiling conductor 13 and the side conductors 14 according to Embodiment 1 of the present invention are formed into a cramp or a U letter.
FIG. 25(B) is a diagram showing the ceiling conductor 13 and the side conductors 14 of FIG. 25(A) along X direction.
FIG. 25(C) is a diagram showing an example of the antenna in which the ceiling conductor 13 and the side conductors 14 according to Embodiment 1 of the present invention are formed into a cramp or an arc.
FIG. 25(D) is a diagram showing the ceiling conductor 13 and the side conductors 14 of FIG. 25(C) along X direction.
Figure 25:
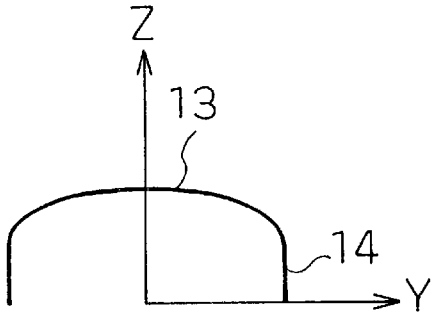
Figure 25:
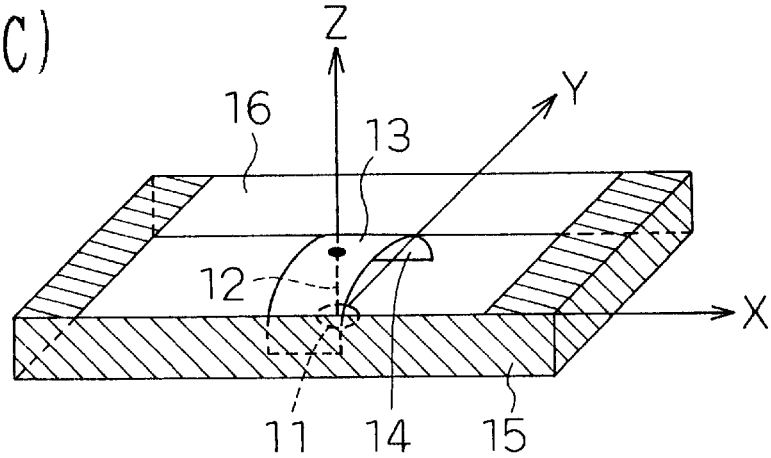
Figure 25:
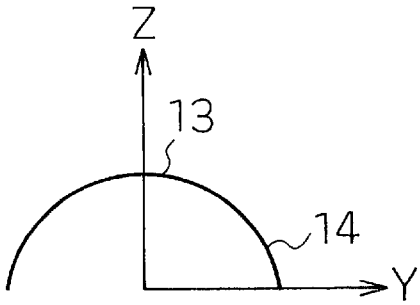

Additionally, as an example, the present embodiment discussed the antenna in which the side conductors 14 and the ceiling conductor 13 are shaped like a letter "ㅋ". The present invention is not always limited to the antenna configured thus. For example, the side conductors 14 and the ceiling conductor 13 may be shaped like a letter U, a cramp, or an arc. Therefore, regarding radiating directivity, the diffraction effect on corners is reduced because the antenna conductor has fewer corners, thereby reducing cross polarization conversion loss of radio waves from the antenna. As an example, FIG. 25 shows the configuration of such an antenna. FIG. 25(A) shows an example of the antenna in which the ceiling conductor 13 and the side conductors 14 are shaped like a letter U, a horseshoe or a cramp. Moreover, FIG. 25(B) shows the ceiling conductor 13 and the side conductors 14 of the antenna shown in FIG. 25(A) taken along X direction. FIG. 25(C) shows an example of the antenna in which the ceiling conductor 13 and the side conductors 14 are formed into an arc or a cramp. Additionally, FIG. 25(D) shows the ceiling conductor 13 and the side conductors 14 of the antenna shown in FIG. 25(C) taken along X direction.

Also, as an example, the present embodiment discussed the antenna in which the side conductors 14 are rectangular and are equal in width to the ceiling conductor 13. The present invention is not always limited to the antenna configured thus. For example, in order to obtain desired radiating directivity and input impedance characteristics, the side conductor 14 may be formed into other polygons, a semicircle, combined shapes thereof, a linear shape, or other shapes. Further, the side conductors 14 may be smaller or larger in width than the ceiling conductor 13. Such configurations can increase adjusting parameters and achieve satisfactory matching between impedance of the antenna and impedance of the feeding line.

Figure 13:
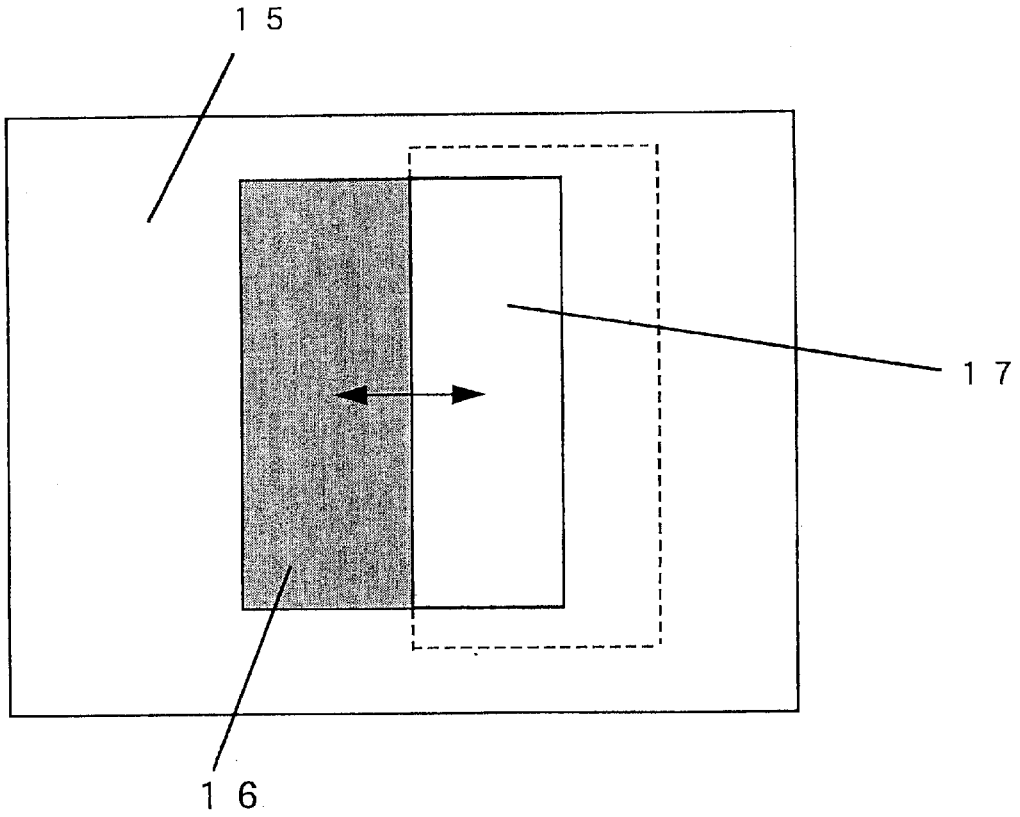
FIG. 13 is a diagram showing an example of the configuration of an opening controller in the antenna according to Embodiments 1, 2, and 3 of the present invention.

Furthermore, as an example, the present embodiment discussed the antenna in which the size of the opening 16 is fixed. The present invention is not always limited to the antenna configured thus. For example, as shown in FIG. 13, the opening 16 may include an opening controller 17 for changing the size of the opening 16. For example, a device and so on for sliding a conducting plate and the like is provided on the opening 16 so as to arbitrarily change the size of the opening 16 and change the radiating directivity of the antenna, thereby achieving desired radiating directivity.

Figure 14:
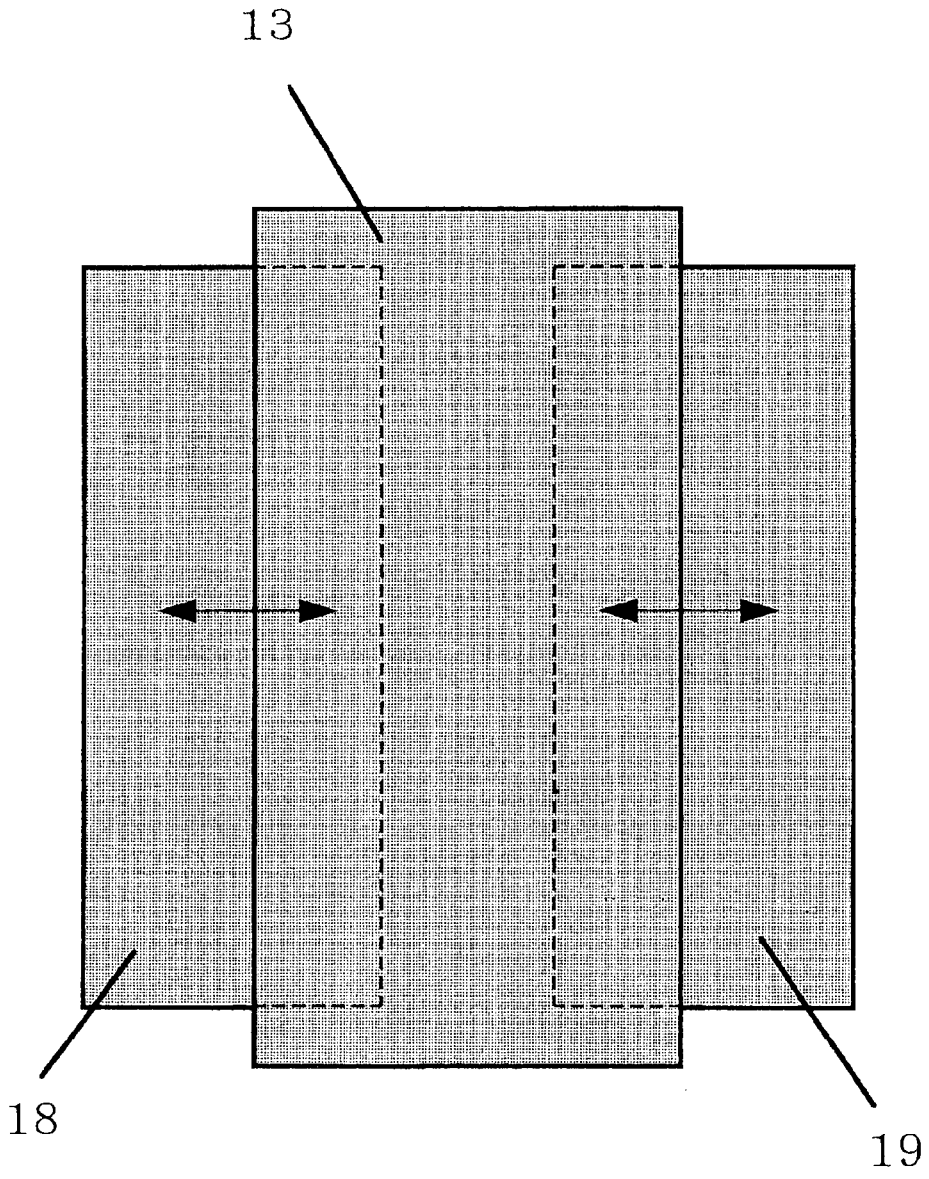
FIG. 14 is a diagram showing an example of the configuration of a ceiling conductor controller in the antenna according to Embodiments 1, 2, and 3 of the present invention.

Further, as an example, the present embodiment discussed the antenna in which the size of the ceiling conductor 13 is fixed. The present, invention is not always limited to the antenna configured thus. For example, as shown in FIG. 14, the ceiling conductor 13 may include ceiling conductor controllers 18 and 19 for changing the size of the ceiling conductor 13. To be specific, a device and so on for sliding a conducting plate and the like is provided on the ceiling conductor 13. Thus, the size of the ceiling conductor 13 is arbitrarily changed, the radiating directivity of the antenna is changed, and desired impedance characteristics and radiating directivity can be achieved.

Moreover, as an example, the present embodiment described that the M-type antenna is somewhat lower in resonance frequency than the cavity. The present invention is not limited to the above configuration. Even when the M-type antenna is somewhat higher in resonance frequency than the cavity, it is possible to achieve the same effects as the present embodiment.

Figure 15:
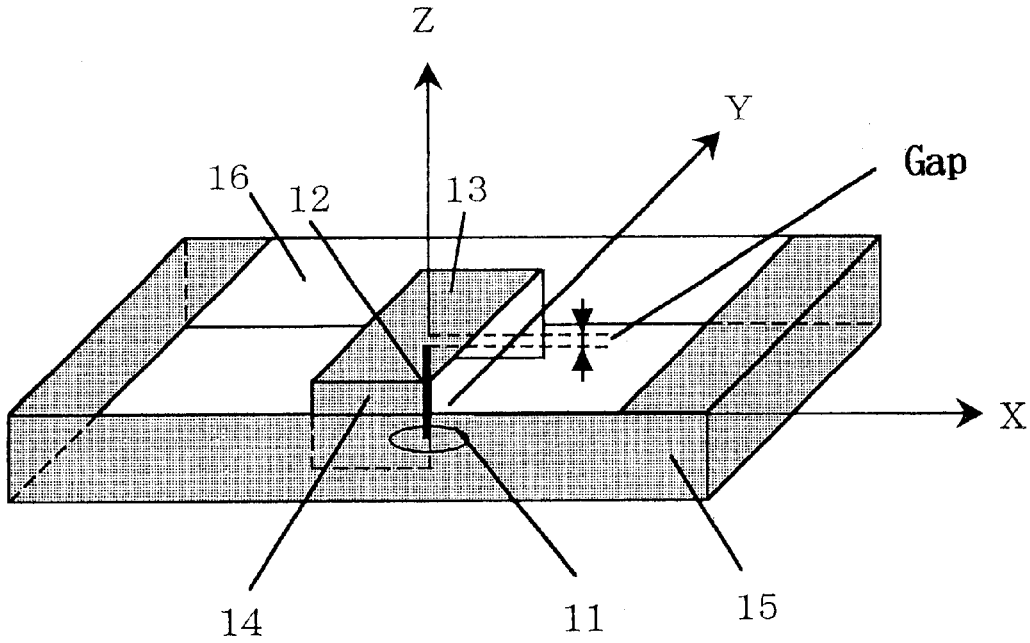
FIG. 15 is a diagram showing an example of the configuration of the antenna according to Embodiments 1, 2, and 3.

Besides, in the present embodiment, the antenna element 12 is composed of a linear conductor. The antenna element 12 may be composed of other antenna elements. For example, the antenna element 12 may be a helical antenna element, which is composed of a spiral conductor line. Thus, the antenna element 12 can be small and lower in height, thereby achieving a small and low-profile antenna. In addition, as shown in FIG. 15, the antenna element 12 may be electrically opened by a part of the ceiling conductor 13 and a gap. Therefore, impedance can be changed and a resonance frequency can be adjusted.

Further, the antenna of the present embodiment may be disposed in an array to form a fused array antenna and an adaptive antenna array. Hence, the directivity of radiated ratio waves can be further controlled.

Embodiment (2)

Next, Embodiment 2 will be discussed.

Embodiment 2 of the present invention will be discussed in accordance with FIG. 16.

Figure 16:
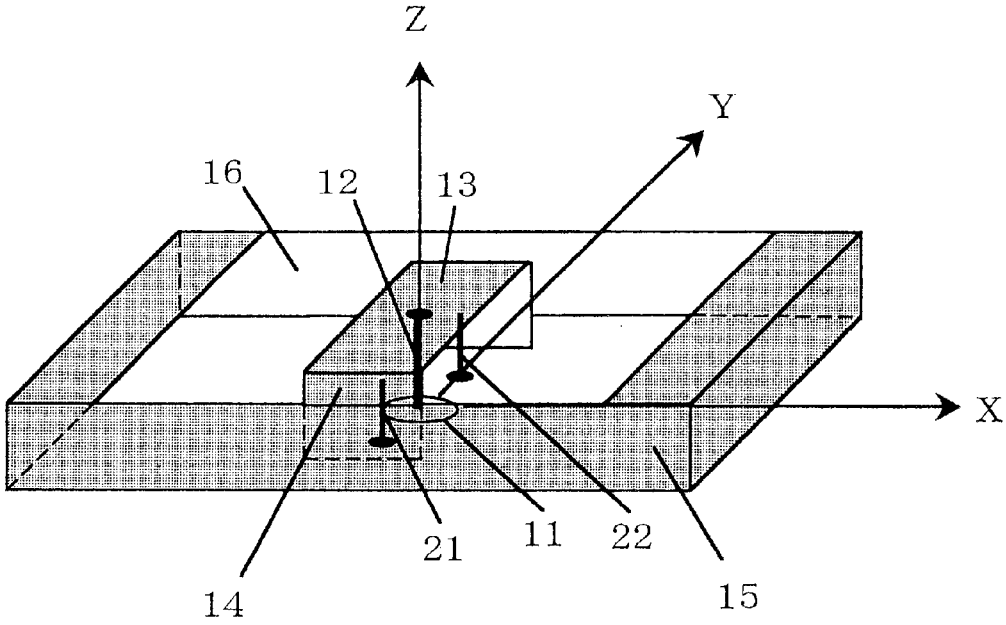
FIG. 16 is a diagram showing an example of the configuration of an antenna according to Embodiment 2 of the present invention.

FIG. 16 shows the configuration of an antenna according to Embodiment 2 of the present invention. In FIG. 16, reference numeral 11 denotes a feeding section, reference numeral 12 denotes an antenna element, reference numeral 13 denotes a ceiling conductor, reference numeral 14 denotes side conductors, reference numeral 15 denotes a cavity, reference numeral 16 denotes an opening, and reference numerals 21 and 22 denote matching conductors. The bottom of the cavity 15 is on XY surface, the feeding section 11 is positioned on a surface of the cavity 15, and the antenna element 12 is connected to the feeding section 11. The side conductors 14 and the ceiling conductor 13 are electrically connected to each other, and the side conductors 14 are electrically connected to the cavity 15. The matching conductors 21 and 22 are electrically connected to the cavity 15.

As an example, the following configuration will be discussed: the cavity 15 forms a rectangular parallelepiped symmetric with respect to ZY surface and ZX surface, the feeding section 11 is disposed on the origin of the XY surface, the ceiling conductor 13 and the side conductors 14 are rectangular and are symmetric with respect to ZY surface and ZX surface, the antenna element 12 is composed of a conductor line perpendicular to XY surface, and the matching conductors 21 and are disposed on Y axis so as to be symmetric with respect to two origins.

The antenna of the present embodiment performs the same operations as the antenna of Embodiment 1.

The antenna of Embodiment 1 may deteriorate matching with the feeding section 11 in some configurations. Further, such deterioration of matching with a feeding section reduces power supplied to the antenna element 12, resulting in lower radiating efficiency of the antenna.

Since the matching conductors 21 and 22 are provided near the antenna element 12 with being spaced from the antenna element 12, it is possible to change impedance of the antenna and to achieve fine matching with the feeding section, thereby improving the characteristics of the antenna. Further, when the matching conductors 21 and 22 are configured such that no influence is exerted on the shape of a conductor, which is formed like a letter "ㅋ" and is composed of the ceiling conductor 13 and the side conductors 14, and the shape of the opening 16, the antenna of the present embodiment hardly changes in radiating directivity as compared with the absence of the matching conductors. This is because, as described in Embodiment 1, actual radiating sources mainly concentrate onto the "ㅋ" shaped conductor and the opening in the antenna of the present embodiment. Namely, it is possible to obtain fine matching of impedance with almost no change in desired radiating characteristics.

Moreover, the present embodiment discussed the antenna which is symmetric with respect to ZY surface and ZX surface. In this case, directivity of radiated radio waves from the antenna is symmetric with respect to ZY surface and ZX surface.

As described above, according to the present embodiment, it is possible to achieve a small antenna which can obtain fine matching of impedance and achieve low loss and bidirectional radiation patterns over a broad band with a simple configuration.

In addition, as an example, the present embodiment discussed the antenna which is symmetric with respect to ZY surface and ZX surface. The present invention is not always limited to the antenna configured thus. For example, in order to obtain desired radiating directivity and input impedance characteristics, a configuration may be symmetric only with respect to ZY surface or may not be symmetric with respect to ZY surface and ZX surface. Further, only the opening 16 may be symmetric with respect to ZY surface or ZY surface and ZX surface. Also, only the cavity 15 may be symmetric with respect to ZY surface or ZY surface and ZX surface. Besides, only the ceiling conductor 13 may be symmetric with respect to ZY surface or ZY surface and ZX surface. Additionally, only the side conductors 14 may be symmetric with respect to ZY surface or ZY surface and ZX surface. Furthermore, the combination thereof is also applicable. Such a configuration can achieve an antenna having radiating directivity being the most suitable for a radiated space.

In addition, as an example, the present embodiment discussed the antenna having a single opening 16. The present invention is not always limited to the antenna configured thus. For example, in order to obtain desired radiating directivity or input impedance characteristics, two or more openings 16 may be provided.

Further, as an example, the present embodiment discussed the antenna in which the opening 16 is rectangular. The present invention is not always limited to the antenna configured thus. For example, in order to obtain desired radiating directivity or input impedance characteristics, the opening 16 may be formed into a circle, a square, a polygon, a semicircle, combined shapes thereof, a ring, or other shapes. When the opening 16 is formed into a circle, an ellipse, or a curved surface, regarding radiating directivity, the diffraction effect is reduced at corners because the antenna conductor has fewer corners, thereby reducing cross polarization conversion loss of radio waves from the antenna.

Besides, as an example, the present embodiment discussed the antenna in which the opening 16 is disposed on the ceiling of the cavity 15. The present invention is not always limited to the antenna configured thus. For example, in addition to the opening 16 disposed on the ceiling of the cavity 15, an opening may be disposed on the side of the cavity to obtain desired radiating directivity or input impedance characteristics.

Furthermore, as an example, the present embodiment discussed the antenna in which the opening 16 is provided on a part of the ceiling of the cavity 15. The present invention is not always limited to the antenna configured thus. For example, the ceiling of the cavity 15 may be entirely opened and the entire ceiling of the cavity 15 may act as an opening 15.

Further, as an example, the present embodiment discussed the antenna in which the bottom of the cavity 15 is a square. The present invention is not always limited to the antenna configured thus. For example, in order to obtain desired radiating directivity or input impedance characteristics, the bottom of the cavity 15 may be formed into other polygons, a semicircle, combined shapes thereof, or other shapes. Furthermore, the bottom of the cavity 15 may be formed into a circle, an ellipse, a curved surface, or other shapes. Therefore, regarding radiating directivity, the diffraction effect is reduced at corners because the antenna conductor has fewer corners, thereby reducing cross polarization conversion loss of radio waves from the antenna.

Further, when the antenna is set on a ceiling and the like, it has been desired that the shape of the antenna match with the squares of the ceiling or the shape of a room such that one is not aware of the antenna. However, when the antenna is formed into a rectangle or other polygons, a direction of setting the antenna is limited because the squares of the ceiling and the shape of the room are fixed. Therefore, in the case where the cavity 15 has a circular bottom, particularly in the case where the antenna has a circular bottom, when the antenna is set on the ceiling, the antenna can be set without considering the squares of the ceiling or the shape of the room.

As an example, FIG. 12 shows the configuration in which the cavity 15 is cylindrical. Further, when the antenna has a circular bottom, the antenna can be rotated to change the setting direction. Hence, a radiating direction of radio waves can be adjusted, thereby achieving radiating characteristics being the most suitable for the setting position of the antenna.

Also, as an example, the present embodiment discussed the antenna in which the ceiling conductor 13 is rectangular. The present invention is not always limited to the antenna configured thus. For example, in order to obtain desired radiating directivity or input impedance characteristics, the ceiling conductor 13 may be formed into other polygons, a semicircle, combined shapes thereof, a linear shape, or other shapes. Further, the ceiling conductor 13 may be formed into a circle, an ellipse, a curved surface, or other shapes. Therefore, regarding radiating directivity, the diffraction effect is reduced on corners because the antenna conductor has fewer corners, thereby reducing cross polarization conversion loss of radio waves from the antenna.

Additionally, as an example, the present embodiment discussed the antenna in which the side conductors 14 and the ceiling conductor 13 are shaped like a letter "ㅋ". The present invention is not always limited to the antenna configured thus. For example, the side conductors 14 and the ceiling conductor 13 maybe shaped like a letter U, a cramp, or an arc. Therefore, regarding radiating directivity, the diffraction effect is reduced on corners because the antenna conductor has fewer corners, thereby reducing cross polarization conversion loss of radio waves from the antenna. As an example, FIG. 25 shows the configuration of such an antenna. FIG. 25(A) and FIG. 25(B) show an example of the antenna in which the ceiling conductor 13 and the side conductors 14 are shaped like a letter U or a cramp. FIG. 25(C) and FIG. 25(D) shows an example of the antenna in which the ceiling conductor 13 and the side conductors 14 are formed into an arc or a cramp.

Also, as an example, the present embodiment discussed the antenna in which the side conductors 14 are rectangular and are equal in width to the ceiling conductor 13. The present invention is not always limited to the antenna configured thus. For example, in order to obtain desired radiating directivity or input impedance characteristics, the side conductors 14 may be formed into other polygons, semicircles, combined shapes thereof, linear shapes, or other shapes. Further, the side conductors 14 may be smaller or larger in width than the ceiling conductor 13. Such configurations can increase adjusting parameters of the impedance and achieve satisfactory matching between impedance of the antenna and impedance of a feeding line.

Furthermore, as an example, the present embodiment discussed the antenna in which the size of the opening 16 is fixed. The present invention is not always limited to the antenna configured thus. For example, as shown in FIG. 13, the opening 16 may include an opening controller 17 for changing the size of the opening 16. For examples a device and so on for sliding a conducting plate and the like is provided on the opening 16 so as to arbitrarily change the size of the opening 16 and change the radiating directivity of the antenna, thereby achieving desired radiating directivity.

Further, as an example, the present embodiment discussed the antenna in which the size of the ceiling conductor 13 is fixed. The present invention is not always limited to the antenna configured thus. For example, as shown in FIG. 14, the ceiling conductor 13 may include ceiling conductor controllers 18 and 19 for changing the size of the ceiling conductor 13. For example, a device and so on for sliding a conducting plate and the like is provided on the ceiling conductor 13 so as to arbitrarily change the size of the ceiling conductor 13 and change the radiating directivity of the antenna, thereby achieving desired impedance characteristics and radiating directivity.

Besides, in the present embodiment, the antenna element 12 is composed of a linear conductor. The present embodiment may be composed of other kinds of antenna elements 12. For example, the antenna element 12 maybe a helical antenna element, which is composed of a spiral conductor line. Thus, the antenna element 12 can be small and low in height, thereby achieving a small and low-profile antenna. In addition, as shown in FIG. 15, the antenna element 12 may be electrically opened by a part of the ceiling conductor 13 and a gap. Therefore, impedance is changed and a resonance frequency can be adjusted.

Additionally, as an example, the present embodiment discussed the antenna having the two matching conductors 21 and 22. The present invention is not always limited to the antenna configured thus. For example, a single matching conductor or three or more matching conductors may be provided. Such a configuration can increase a degree of freedom in the configuration and further improve matching with the feeding section.

Besides, as an example, the present embodiment discussed the antenna in which the matching conductors 21 and 22 are disposed on Y axis so as to be away from the antenna element. The present invention is not always limited to the antenna configured thus. For example, the matching conductors 21 and 22 maybe disposed at any position on XY surface on a grounding conductor. Such a configuration can increase a degree of freedom in the configuration and further improve matching with the feeding section.

Further, in the present embodiment, the matching conductors 21 and 22 are composed of linear conductors. The matching conductors 21 and 22 may be composed of conductors formed in other shapes. For example, the conductors 21 and 22 may be composed of a helical matching conductor, which is formed by a spiral conductor line, or a conductor line bent into an L shape. Thus, the matching conductors 21 and 22 can be small and low in height, thereby achieving a small and low-profile antenna.

Figure 17:
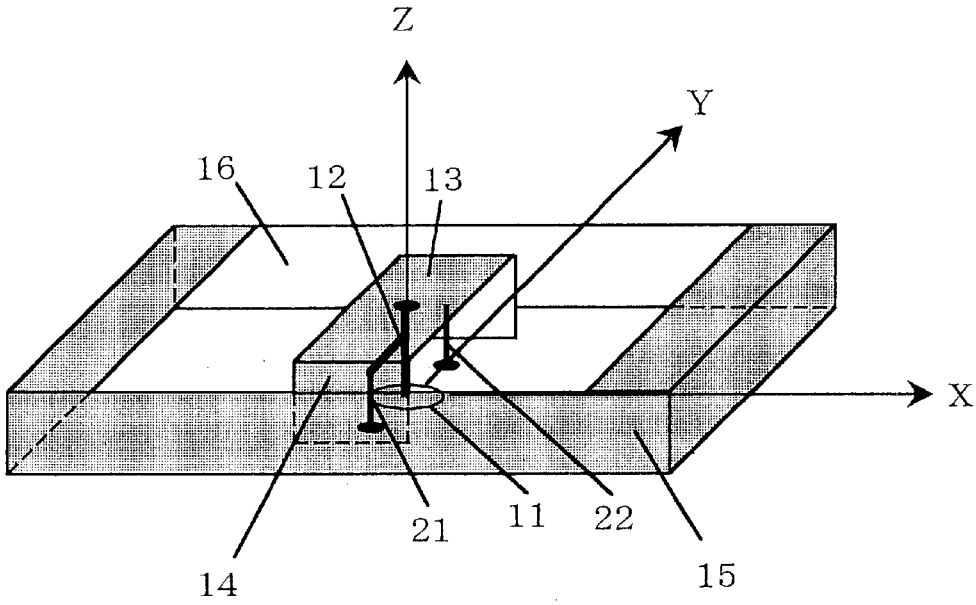
FIG. 17 is a diagram showing an example of the configuration of an antenna according to Embodiment 2 of the present invention.

Further, as an example, the present embodiment discussed the antenna in which the matching conductors 21 and 22 are disposed away from the antenna element 12. The present invention is not always limited to the antenna configured thus. For example, as shown in FIG. 17, the ends of parts or the entire of the matching conductors 21 and 22 may be electrically connected to a midpoint of the antenna element. Such a configuration can increase impedance of the antenna and achieve fine matching with the feeding section particularly when the antenna has low impedance.

Figure 18:
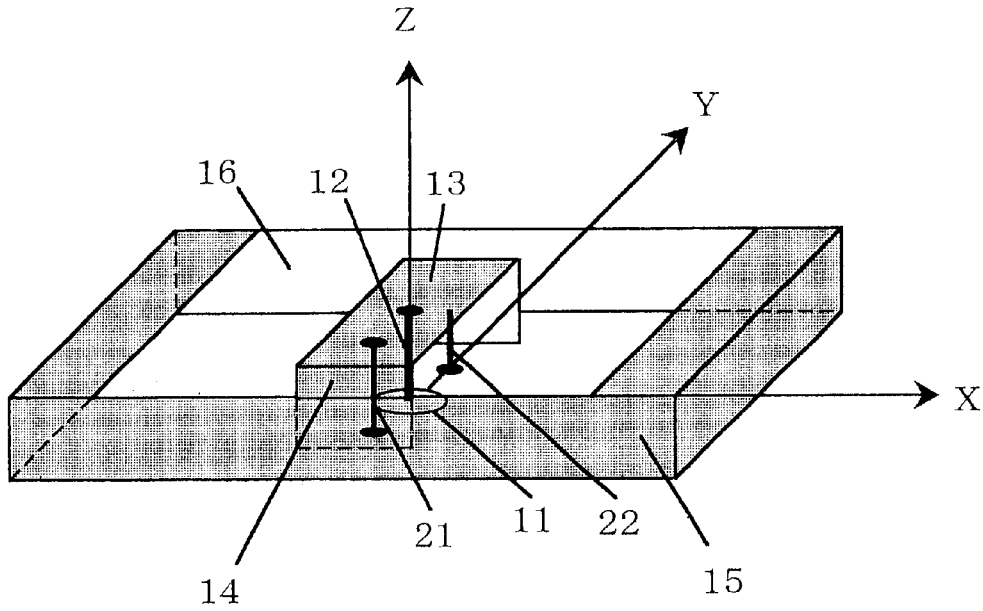
FIG. 18 is a diagram showing an example of the configuration of an antenna according to Embodiment 2 of the present invention.

Moreover, as an example, the present embodiment discussed the antenna in which the matching conductors 21 and 22 are not connected to the ceiling conductor 13. The present invention is not always limited to the antenna configured thus. For example, as shown in FIG. 18, the ends of parts or the entire of the matching conductors 21 and 22 may be electrically connected to the ceiling conductor 13. Such a configuration can increase impedance of the antenna and achieve fine matching with the feeding section when the antenna has low impedance.

Furthermore, the antenna of the present embodiment may be disposed in an array to form a fused array antenna and an adaptive antenna array. Hence, the directivity of radiated radio waves can be further controlled.

Embodiment (3)

Embodiment 3 of the present invention will be discussed in accordance with FIG. 19.

Figure 19:
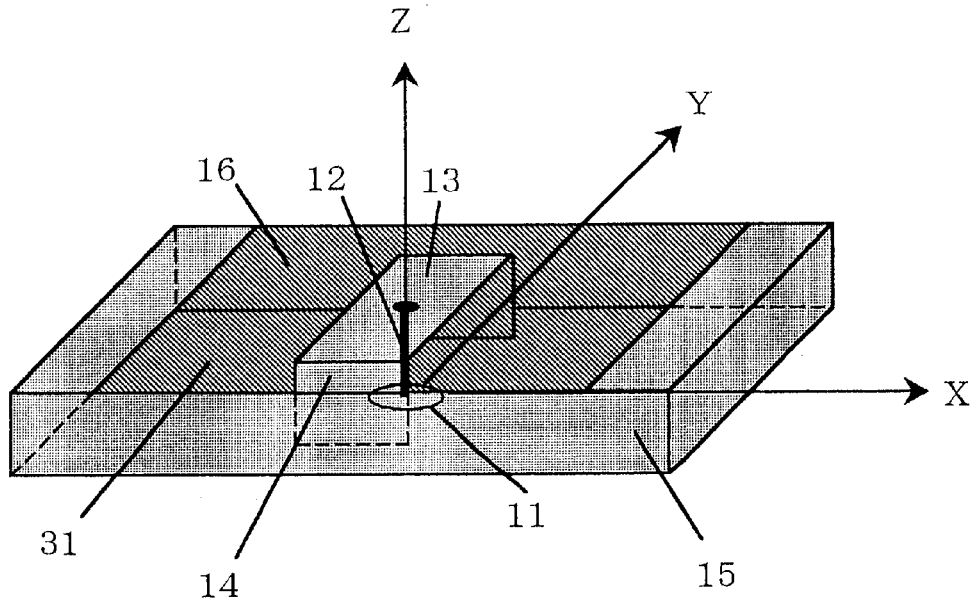
FIG. 19 is a diagram showing an example of the configuration of an antenna according to Embodiment 3 of the present invention.

FIG. 19 shows the configuration of an antenna according to Embodiment 3 of the present invention.

In FIG. 19, reference numeral 11 denotes a feeding section, reference numeral 12 denotes an antenna element, reference numeral 13 denotes a ceiling conductor, reference numeral 14 denotes side conductors, reference numeral 15 denotes a cavity, reference numeral 16 denotes an opening, and reference numeral 31 denotes a dielectric. The bottom of the cavity 15 is on XY surface, the feeding section 11 is positioned on a surface of the cavity 15, and the antenna element 12 is connected to the feeding section 11. The side conductors 14 and the ceiling conductor 13 are electrically connected to each other, and the side conductors 14 are electrically connected to the cavity. The matching conductors 21 and 22 are electrically connected to the cavity 15.

As an example, the following configuration will be discussed: the cavity 15 forms a rectangular parallelepiped symmetric with respect to ZY surface and ZX surface, the feeding section 11 is disposed on the origin of XY surface, the ceiling conductor 13 and the side conductors 14 are rectangular and are symmetric with respect to ZY surface and ZX surface, the antenna element 12 is composed of a conductor line perpendicular to XY surface, and the matching conductors 21 and 22 are disposed on Y axis so as to be symmetric with respect to two origins.

Here, a space surrounded by the cavity 15 is referred to as an interior of the antenna, and a space being opposite to the interior of the antenna relative to the cavity 15 is referred to as an exterior of the antenna.

The antenna of the present embodiment performs the same operations as the antenna of Embodiment 1.

In the present embodiment, the dielectric 31 is inserted into the antenna. When a ratio of the dielectric constant of the dielectric 31 to the one of dielectric constant of vacuum, $\epsilon 0$, (relative dielectric constant) is $\epsilon r$ a wavelength in the dielectric 31 is $1/\sqrt{\epsilon r}$ times that in a vacuum. The wavelength is short in the dielectric 31 because $\epsilon r$ is 1 or more. For this reason, the antenna can be smaller and thinner by inserting the dielectric 31 into the antenna.

Moreover, the antenna of the present embodiment is configured such that a dielectric substrate is inserted into the antenna. Thus, the antenna can be formed by using a dielectric substrate having conductive foil on both surfaces.

For example, the dielectric substrate is cut and conductive foil on one of the surfaces is removed by etching, mechanical working, and the like to form the conductor on the ceiling of the cavity 15, the ceiling conductor 13, and the opening 16. At this moment, conductive foil on the other side of the substrate serves as the bottom of the cavity.

Further, a suitable hole is made on the bottom of the cavity to form a coaxial feeding section 11. A hole is made on the dielectric substrate to allow a protruding end of a conductor line to protrude from the ceiling conductor 13 to the outside of the substrate. The conductor line extends from the conductor of the coaxial feeding section 11. The ceiling conductor 13 and the protruding end of the conductor line are electrically connected to the ceiling conductor by soldering and so on.

And then, the sides of the substrate are covered with a via or conductor to form side conductors of the cavity 15. Further, the side conductors 14 are formed by a via.

Figure 20:
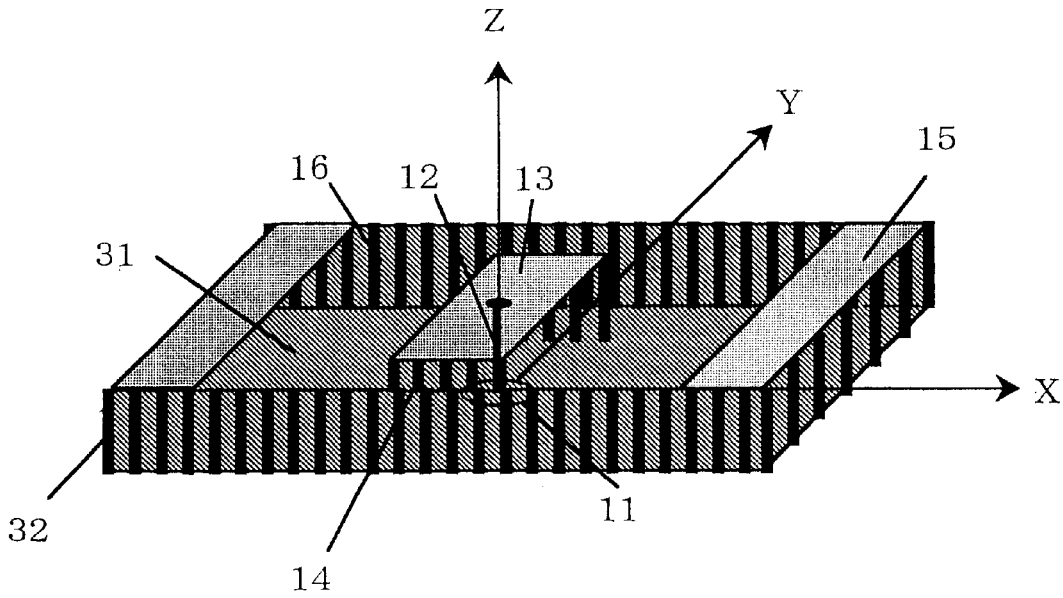
FIG. 20 is a diagram showing an example of the configuration of an antenna according to Embodiment 3 of the present invention.
Figure 21:
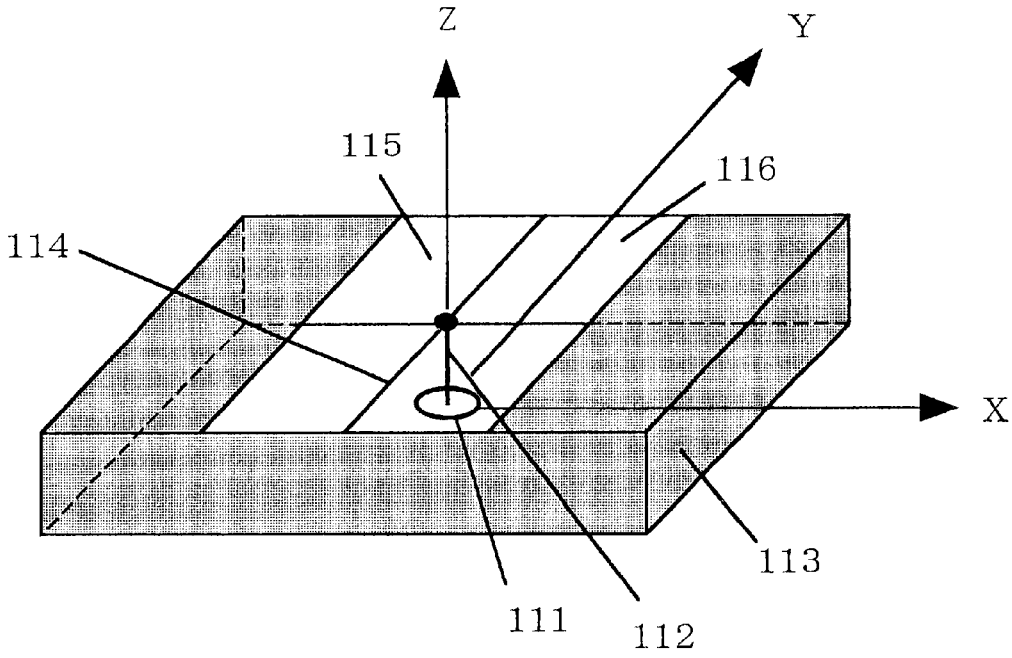
Fig. 21 PRIOR ART
FIG. 21 is a diagram showing the configuration of a conventional antenna.
Figure 22:
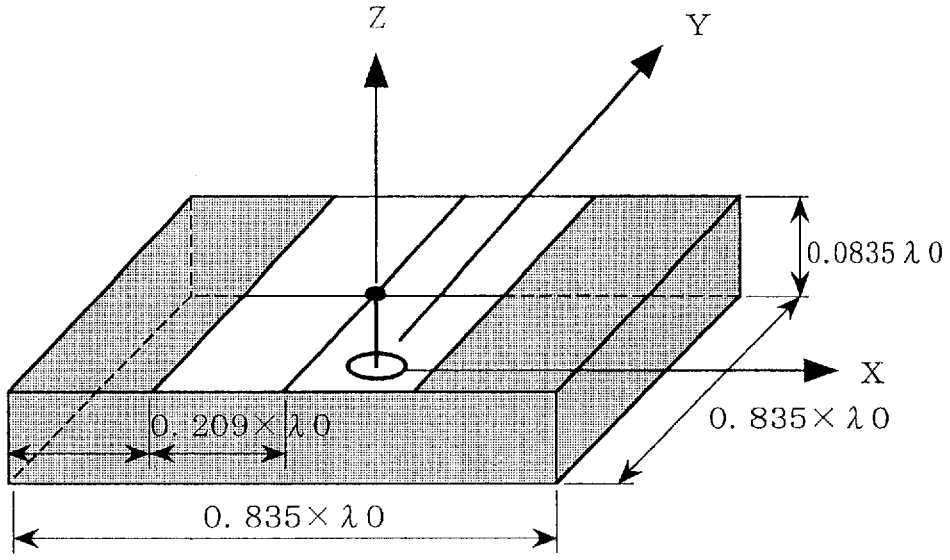
Fig. 22 PRIOR ART
FIG. 22 is a diagram showing an example of a prototype of the conventional antenna.
Figure 23:
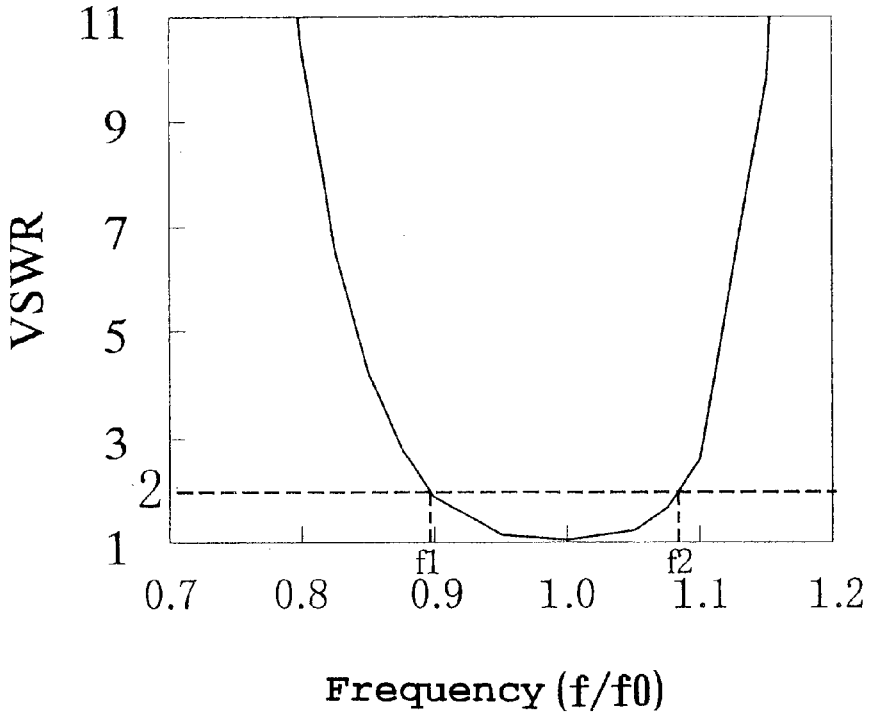
Fig. 23 PRIOR ART
FIG. 23 is a diagram showing impedance characteristics of the prototype of the conventional antenna.
Figure 24:
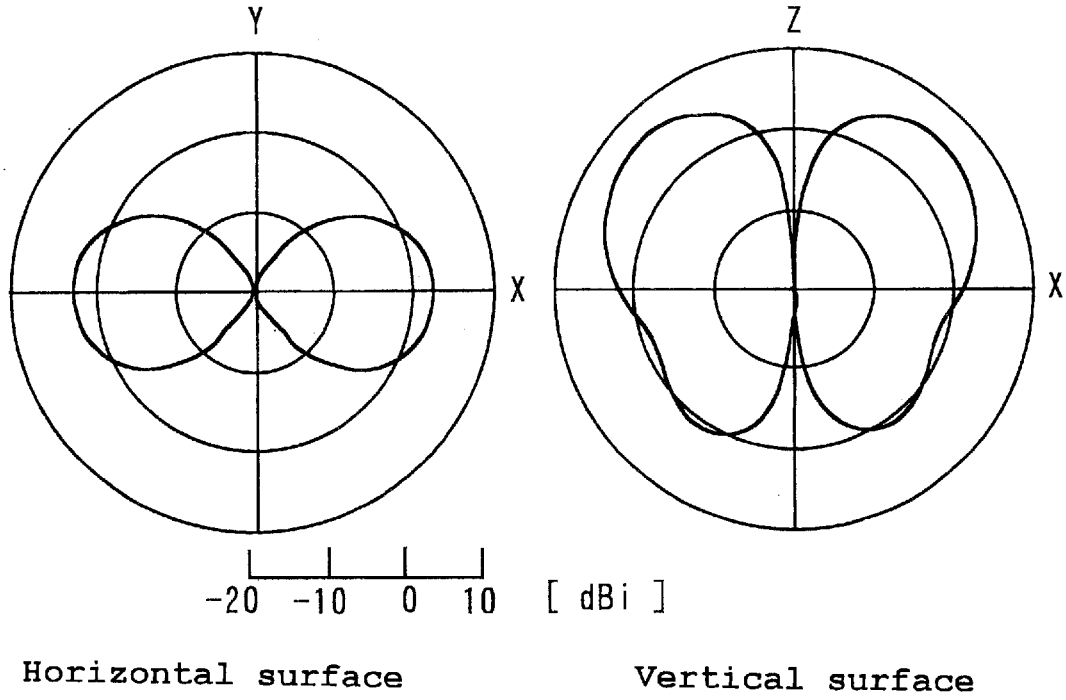
Fig. 24 PRIOR ART
FIG. 24 is a diagram showing radiating characteristics of the prototype of the conventional antenna.

FIG. 20 shows that a via forms the sides of a cavity 15 and side conductors 14. In FIG. 20, reference numeral 11 denotes a feeding section, reference numeral 12 denotes an antenna element, reference numeral 13 denotes a ceiling conductor, reference numeral 14 denotes side conductors, reference numeral 15 denotes a cavity, reference numeral 16 denotes an opening, reference numeral 31 denotes a dielectric, and reference numeral 32 denotes a via.

Since substrate working such as etching is performed with working accuracy, it is possible to improve accuracy of manufacturing the antenna and to reduce the cost by mass production.

Further, since conventional antennas have openings, in some setting environments of the antenna, air containing much dust and moisture enters the inside of the antenna from the opening. Thus, the characteristics of the antenna may be deteriorated. However, by filling the dielectric 31 in the antenna, it is possible to prevent deterioration in characteristics that is caused by the entry of air containing much dust and moisture.

As described above, according to the present embodiment, it is possible to achieve a small and thin antenna, which has high working accuracy and little deterioration in characteristics of the antenna with a simple configuration, and which has low-loss characteristics over a broad band and bidirectional radiation patterns over a broad band regarding radiating characteristics.

Besides, as an example, the present embodiment discussed the antenna in which the interior of the antenna surrounded by the conductor is entirely filled with the dielectric 31. The present invention is not always limited to the antenna configured thus. The dielectric 31 may exist partially in the interior of the antenna. For example, the antenna may be formed by combining the following members: a part or the entire of the cavity 15, the ceiling conductor 13, the side conductors 14, or the opening 16 that are formed by removing conductive foil by etching or mechanical working, which uses a dielectric substrate having conductive foil on one of the surfaces. In this manner, since the conductor having the opening 16 is manufactured by using the dielectric substrate, it is possible to prevent deterioration in characteristics that is caused by the entry of air containing much dust and moisture into the interior of the antenna.

Embodiment (4)

The following will discuss Embodiment 4.

Embodiment 4 of the present invention will be discussed in accordance with FIG. 26.

Figure 26:
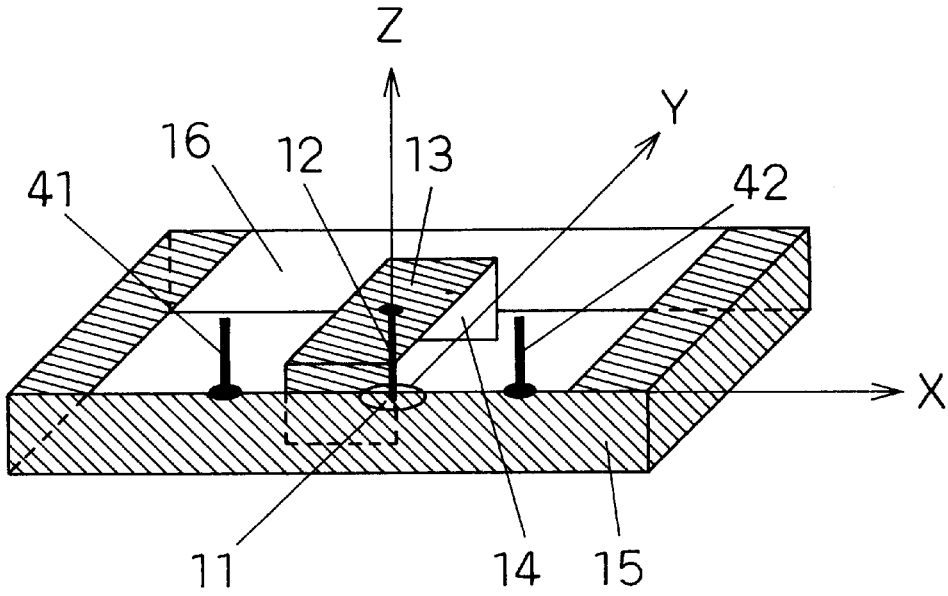
FIG. 26 is a diagram showing an example of the configuration of an antenna according to Embodiment 4 of the present invention.

FIG. 26 shows the configuration of an antenna according to Embodiment 4 of the present embodiment. In FIG. 26, reference numeral 11 denotes a feeding section, reference numeral 12 denotes an antenna element, reference numeral 13 denotes a ceiling conductor, reference numeral 14 denotes side conductors, reference numeral 15 denotes a cavity, reference numeral 16 denotes an opening, reference numerals 41 and 42 denote directivity control conductors. The bottom of the cavity 15 is on XY surface, the feeding section 11 is positioned on a surface of the cavity 15, and the antenna element 12 is connected to the feeding section 11. The side conductors 14 and the ceiling conductor 13 are electrically connected to each other, and the side conductors 14 are electrically connected to the cavity 15. The directivity control conductors 41 and 42 are electrically connected to the bottom of the cavity 15 and are positioned at equal distances from the origin on X axis.

As an example, the following configuration will be discussed: the cavity 15 forms a rectangular parallelepiped symmetric with respect to ZY surface and ZX surface, the feeding section 11 is disposed on the origin of XY surface, the ceiling conductor 13 and the side conductors 14 are rectangular and are symmetric with respect to ZY surface and ZX surface, and the antenna element 12 is composed of a conductor line perpendicular to XY surface.

The operations of the antenna of the present embodiment are basically the same as those of the antenna of Embodiment 1.

The difference from Embodiment 1 is that directivity of the antenna can be controlled by the directivity control conductors 41 and 42. Namely, since the directivity control conductors 41 and 42 are disposed at equal distances from the origin on X axis, directivity in X direction can be higher than the antenna of the Embodiment 1 while bidirectivity is maintained. In this manner, the antenna of the present embodiment can control directivity on a vertical surface.

For example, when an antenna is set in a space such as a corridor, which is long in a horizontal direction and low in height, it is necessary to strongly radiate radio waves in a horizontal direction. Therefore, the antenna of the present embodiment is suitable for a space such as a corridor, which is long in a horizontal direction and low in height.

As described above, the directivity control conductors 41 and 42 are disposed so as to be symmetric with respect to ZY surface or ZX surface. Thus, it is possible to increase directivity in X direction while bidirectional radiation patterns are maintained.

In addition, the present embodiment described that the directivity control conductors 41 and 42 are disposed on X axis. The present invention is not limited to the above configuration. When the directivity control conductors 41 and 42 are shifted in Y direction, directivity of the antenna is accordingly directed in the shifting direction. Therefore, when the antenna is set at a site for setting the antenna, the antenna can be readily adjusted such that the most suitable directivity can be obtained simply by adjusting the positions of the directivity control conductors 41 and 42.

In this case, a plurality of holes or instructing parts is provided in advance on the bottom of the cavity 15 to support the directivity control conductors 41 and 42. When the antenna is set at the site, directivity of the antenna can be controlled simply by inserting the directivity control conductors 41 and 42 into the holes or supporting parts. In this manner, by using the directivity control conductors 41 and 42, directivity of the antenna can be readily adjusted not when the antenna is manufactured but when the antenna is set at the site.

Further, the present embodiment described that the directivity control conductors 41 and 42 are vertical conductors as shown in FIG. 26. The present invention is not limited to the above configuration. The directivity control conductors 41 and 42 may be horizontal or diagonal to the cavity 15. Moreover, the directivity control conductors 41 and 42 may not be connected to the cavity 15. Besides, the directivity control conductors 41 and 42 may not be formed into bars shown in FIG. 26 but may be formed into any shapes such as a circle.

Additionally, the two directivity control conductors 41 and 42 are provided in FIG. 26 of the present embodiment. It is also possible to provide an arbitrary number such as four and six of conductors.

(Embodiment 5)

The following will discuss Embodiment 5.

Figure 27:
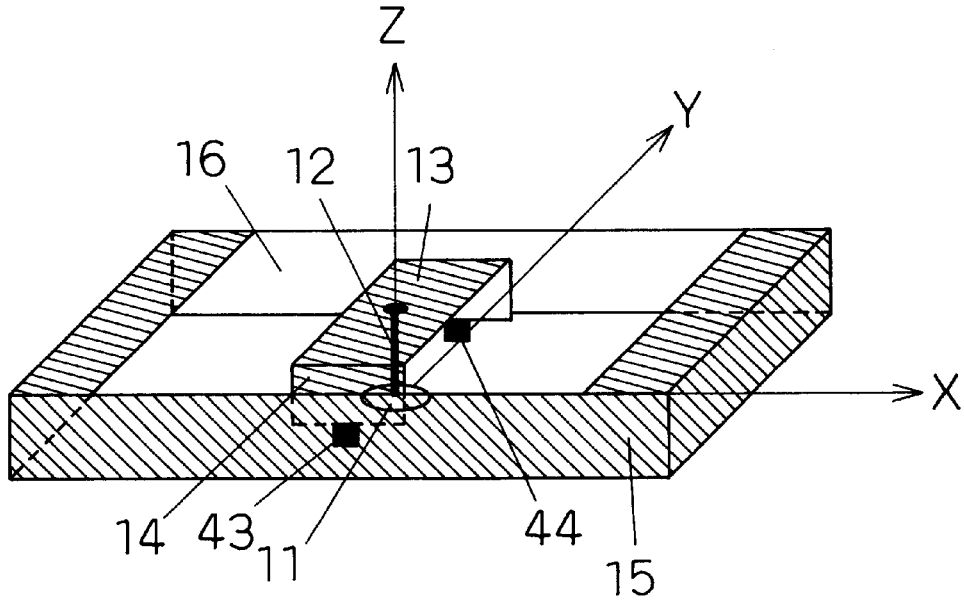
FIG. 27 is a diagram showing an example of the configuration of an antenna according to Embodiment 5 of the present invention.

The following will discuss Embodiment 5 of the present embodiment in accordance with FIG. 27.

FIG. 27 shows the configuration of an antenna according to Embodiment 5 of the present invention. In FIG. 27, reference numeral 11 denotes a feeding section, reference numeral 12 denotes an antenna element, reference numeral 13 denotes a ceiling conductor, reference numeral 14 denotes side conductors, reference numeral 15 denotes a cavity, reference numeral 16 denotes an opening. The bottom of the cavity 15 is on XY surface, the feeding section 11 is positioned on a surface of the cavity 15, and the antenna element 12 is connected to the feeding section 11. The side conductors 14 and ceiling conductor 13 are electrically connected to each other, and capacitors 43 and 44 are inserted between the side conductors 14 and the cavity 15.

As an example, the following configuration will be discussed: the cavity 15 forms a rectangular parallelepiped symmetric with respect to ZY surface and ZX surface, the feeding section 11 is disposed on the origin of XY surface, the ceiling conductor 13 and the side conductors 14 are rectangular and are symmetric with respect to ZY surface and ZX surface, and the antenna element 12 is composed of a conductor line perpendicular to XY surface.

The operations of the antenna of the present embodiment are basically the same as those of the antenna of Embodiment 1.

The difference from Embodiment 1 is that a height from the bottom of the cavity 15 to the ceiling conductor 13 can be reduced by inserting the capacitors 43 and 44 between the side conductors 14 and the cavity 15. Hence, by using the capacitors 43 and 44, the antenna can be reduced in height when the antenna is too tall, etc.

Figure 28:
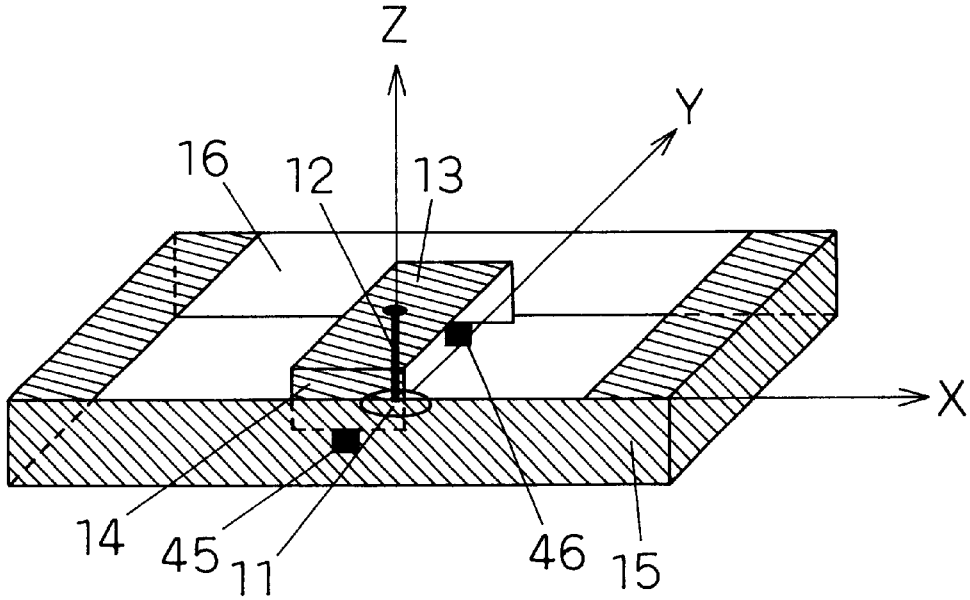
FIG. 28 is a diagram showing an example of the configuration of an antenna according to Embodiment 5 of the present invention.

Moreover, FIG. 28 shows that the capacitors 43 and 44 of the antenna of FIG. 27 are replaced with coils 45 and 46. By using the coils 45 and 46, the antenna can be increased in height when the antenna is too low in height, etc.

Besides, as an example, the present embodiment discussed the antenna which is symmetric with respect to ZY surface and ZX surface. The present invention is not always limited to the antenna configured thus. For example, in order to obtain desired radiating directivity or input impedance characteristics, a configuration may be symmetric only with respect to ZY surface or a configuration may not be symmetric with respect to ZY surface and ZX surface. Further, only the opening 16 may be symmetric with respect to ZY surface or ZY surface and ZX surface. Also, only the cavity 15 may be symmetric with respect to ZY surface or ZY surface and ZX surface. Besides, only the ceiling conductor 13 may be symmetric with respect to ZY surface or ZY surface and ZX surface. Additionally, only the side conductors 14 may be symmetric with respect to ZY surface or ZY surface and ZX surface. Furthermore, the combination thereof is also applicable. Such a configuration can achieve an antenna with radiating directivity being the most suitable for a radiated space.

In addition, as an example, the present embodiment discussed the antenna having a single opening 16. The present invention is not always limited to the antenna configured thus. For example, in order to obtain desired radiating directivity or input impedance characteristics, two or more openings 16 may be provided.

Further, as an example, the present embodiment discussed the antenna in which the opening 16 is rectangular. The present invention is not always limited to the antenna configured thus. For example, in order to obtain desired radiating directivity or input impedance characteristics, the opening 16 may be formed into a circle, a square, a polygon, a semicircle, combined shapes thereof, a ring, or other shapes. When the opening 16 is formed into a circle, an ellipse, or a curved surface, regarding radiating directivity, the diffraction effect is reduced at corners because the antenna conductor has fewer corners, thereby reducing cross polarization conversion loss of radio waves from the antenna.

Additionally, as an example, the present embodiment discussed the antenna in which the side conductors 14 and the ceiling conductor 13 are shaped like a letter "ㅋ". The present invention is not always limited to the antenna configured thus. For example, the side conductors 14 and the ceiling conductor 13 may be shaped like a letter U, a cramp, or an arc. Therefore, regarding radiating directivity, the diffraction effect is reduced on corners because the antenna conductor has fewer corners, thereby reducing cross polarization conversion loss of radio waves from the antenna. As an example, FIG. 25 shows the configuration of such an antenna. FIG. 25(A) and FIG. 25(B) show an example of the antenna in which the ceiling conductor 13 and the side conductors 14 are shaped like a letter U or a cramp. FIG. 25(C) and FIG. 25(D) show an example of the antenna in which the ceiling conductor 13 and the side conductors 14 are formed into an arc or a cramp.

Besides, as an example, the present embodiment discussed the antenna in which the opening 16 is disposed on the ceiling of the cavity. The present invention is not always limited to the antenna configured thus. For example, in addition to the opening 16 disposed on the ceiling of the cavity 15, an opening may be disposed on the side of the cavity 15 to obtain desired radiating directivity or input impedance characteristics.

Also, the present embodiment discussed the antenna in which the opening 16 is disposed on a part of the ceiling of the cavity 15. The present invention is not always limited to the antenna configured thus. For example, the ceiling of the cavity 15 may be entirely opened and may be entirely used as an opening 15.

Further, as an example, the present embodiment discussed the antenna in which the bottom of the cavity 15 is a square. The present invention is not always limited to the antenna configured thus. For example, in order to obtain desired radiating directivity or input impedance characteristics, the bottom of the cavity 15 may be formed into other polygons, a semicircle, combined shapes thereof, or other shapes. Furthermore, the bottom of the cavity 15 may be formed into a circle, an ellipse, a curved surface, or other shapes. Therefore, regarding radiating directivity, the diffraction effect is reduced at corners because the antenna conductor has fewer corners, thereby reducing cross polarization conversion loss of radio waves from the antenna.

Further, when the antenna is set on a ceiling and the like, it has been desired that the shape of the antenna match with the squares of the ceiling or the shape of a room such that one is not aware of the antenna. However, when the antenna is formed into a rectangle or other polygons, a direction of setting the antenna is limited because the squares of the ceiling and the shape of the room are fixed. Therefore, in the case where the cavity 15 has a circular bottom, particularly in the case where the antenna has a circular bottom, it is an advantage that when the antenna is set on the ceiling, the antenna can be set without considering the squares of the ceiling or the shape of the room.

As an example, FIG. 12 shows the configuration in which the cavity 15 is cylindrical. Further, when the antenna has a circular bottom, the antenna can be rotated to change the setting direction. Hence, a radiating direction of radio waves can be adjusted, thereby achieving radiating characteristics being the most suitable for the setting position of the antenna.

Also, as an example, the present embodiment discussed the antenna in which the ceiling conductor 13 is rectangular. The present invention is not always limited to the antenna configured thus. For example, in order to obtain desired radiating directivity or input impedance characteristics, the ceiling conductor 13 may be formed into other polygons, a semicircle, combined shapes thereof, a linear shape, or other shapes. Further, the ceiling conductor 13 may be formed into a circle, an ellipse, a curved surface, or other shapes. Therefore, regarding radiating directivity, the diffraction effect is reduced on corners because the antenna conductor has fewer corners, thereby reducing cross polarization conversion loss of radio waves from the antenna.

Also, as an example, the present embodiment discussed the antenna in which the side conductors 14 are rectangular and are equal in width to the ceiling conductor 13. The present invention is not always limited to the antenna configured thus. For example, in order to obtain desired radiating directivity or input impedance characteristics, the side conductors 14 may be formed into other polygons, semicircles, combined shapes thereof, linear shapes, or other shapes. Further, the side conductors 14 may be smaller or larger in width than the ceiling conductor 13. Such configurations can increase adjusting parameters of impedance and achieve satisfactory matching between impedance of the antenna and impedance of a feeding line.

Furthermore, as an example, the present embodiment discussed the antenna in which the size of the opening 16 is fixed. The present invention is not always limited to the antenna configured thus. For example, as shown in FIG. 13, the opening 16 may include an opening controller 17 for changing the size of the opening 16. For example, a device and so on for sliding a conducting plate and the like is provided on the opening 16 so as to arbitrarily change the size of the opening 16 and change the radiating directivity of the antenna, thereby achieving desired radiating directivity.

Further, as an example, the present embodiment discussed the antenna in which the size of the ceiling conductor 13 is fixed. The present invention is not always limited to the antenna configured thus. For example, as shown in FIG. 14, the ceiling conductor 13 may include ceiling conductor controllers 18 and 19 for changing the size of the ceiling conductor 13. For example, a device and so on for sliding a conducting plate and the like is provided on the ceiling conductor 13 so as to arbitrarily change the size of the ceiling conductor 13 and change the radiating directivity of the antenna, thereby achieving desired impedance characteristics and radiating directivity.

Besides, in the present embodiment, the antenna element 12 is composed of a linear conductor. The antenna element 12 may be composed of other antenna elements. For example, the antenna element 12 may be a helical antenna element, which is composed of a spiral conductor line. Thus, the antenna element 12 can be small and low-profile, thereby achieving a small and low-profile antenna. In addition, as shown in FIG. 15, the antenna element 12 may be electrically opened by a part of the ceiling conductor 13 and a gap. Therefore, impedance can be changed and a resonance frequency can be adjusted.

Furthermore, the antenna of the present embodiment may be disposed in an array to form a fused array antenna and an adaptive antenna array. Hence, the directivity of radiated radio waves can be further controlled.

Besides, the cavity 15 of the present embodiment is an example of a conductive case of the present invention. The side conductors 14 and the ceiling conductor 13 of the present embodiment are examples of internal conductors of the present invention. The antenna element 12 of the present embodiment is an example of a feeding element of the present invention. The joint of the antenna element 12 and the ceiling conductor 13 of the present embodiment is an example of the feeding section of the present invention. When a gap is provided between the antenna element 12 and the ceiling conductor 13 of the present embodiment, the ceiling conductor controllers 18 and 19 of the present embodiment are examples of ceiling conductor adjusting means of the present invention, and the opening controller 17 of the present embodiment is an example of an opening controlling means of the present invention.

As described above, according to the present embodiment, since the antenna element 12 surrounded by the side conductors 14 and the ceiling conductor 13 is disposed inside the cavity 15, it is possible to achieve an antenna which has low loss over a broad band and bidirectional radiation patterns with a simple configuration.

As described above, the present invention can provide an antenna which is small particularly on its upper side and obtains bidirectional radiation patterns over a broad band.

What is claimed is:

1. An antenna, comprising:

a conductive case having at least a single opening on an upper part, an internal conductor disposed in said case, and generally shaped like a letter "u", a letter "U", or an arc, and a feeding element connected to a feeding section disposed on a bottom of said conductive case, wherein at least one opposing end of said internal conductor is connected to said bottom of said conductive case.

2. The antenna according to claim 1, wherein said feeding element is connected to a ceiling of said internal conductor.

3. The antenna according to claim 1, further comprising a gap for electrically opening said feeding element from a feeding section of said internal conductor, said gap being provided between said feeding element and a ceiling of said internal conductor.

4. The antenna according to claim 1, further comprising at least one or more matching conductors being electrically connected to said conductive case.

5. The antenna according to claim 4, wherein at least one or more of said matching conductors are electrically connected to said feeding element.

6. The antenna according to claim 4, wherein at least one or more of said matching conductors are electrically connected to said internal conductor.

7. The antenna according to claim 1, wherein a space including said feeding element is entirely or partially filled with a dielectric, said space being surrounded by said conductive case.

8. The antenna according to claim 1, wherein said bottom of said conductive case is circular.

9. The antenna according to claim 1, wherein said bottom of said conductive case is a rectangular parallelepiped.

10. The antenna according to claim 1, wherein when said internal conductor is shaped like a letter "u", a letter "U", or an arc, a length of a ceiling of said internal conductor, in a direction parallel to a direction from a part to the other part that are in contact with said conductive case is shorter than a wavelength of the highest frequency in a frequency band having better characteristics than predetermined characteristics.

11. The antenna according to claim 1, further comprising at least one or more directivity control conductors.

12. The antenna according to claim 1, wherein a resonance frequency of said internal conductor, a resonance frequency of said conductive case on a surface in parallel with said internal conductor and perpendicular to said bottom of said conductive case, and a resonance frequency of said conductive case on a surface perpendicular to said internal conductor and said bottom of said conductive case are different from one another.

13. The antenna according to claim 1, wherein said internal conductor is connected to said conductive case via a capacitor.

14. The antenna of claim 1 wherein both opposing ends of said internal conductor are electrically connected to the bottom of said case.

15. The antenna of claim 1 wherein both opposing ends of said internal conductor are electrically connected only to the bottom of said case.

16. An antenna comprising:

a conductive case having at least a single opening on an upper part, an internal conductor disposed in said case, and generally shaped like a letter "u", a letter "U", or an arc, and a feeding element connected to a feeding section disposed on a bottom of said conductive case, wherein said internal conductor is connected to said bottom of said conductive case, and a space including said feeding element is entirely or partially filled with a dielectric, said space being surrounded by said conductive case, said dielectric is a dielectric substrate, said conductive case includes a metallic foil pattern attached on said dielectric substrate and/or a via provided on said dielectric substrate, said internal conductor has a ceiling including said metallic foil pattern attached on said dielectric substrate, and said internal conductor has a side including said via provided on said dielectric substrate.

17. An antenna comprising:

a conductive case having at least a single opening on an upper part, an internal conductor disposed in said case, and generally shaped like a letter "u", a letter "U", or an arc, and a feeding element connected to a feeding section disposed on a bottom of said conductive case, wherein said internal conductor is connected to said bottom of said conductive case, and opening control means of adjusting a size of said opening.

18. An antenna comprising:

a conductive case having at least a single opening on an upper part, an internal conductor disposed in said case, and generally shaped like a letter "u", a letter "U", or an arc, and a feeding element connected to a feeding section disposed on a bottom of said conductive case, wherein said internal conductor is connected to said bottom of said conductive case, and ceiling conductor adjusting means of adjusting a ceiling size of said internal conductor.

19. An antenna comprising:

a conductive case having at least a single opening on an upper part, an internal conductor disposed in said case, and generally shaped like a letter "u", a letter "U", or an arc, and a feeding element connected to a feeding section disposed on a bottom of said conductive case, wherein said internal conductor is connected to said bottom of said conductive case, and when using rectangular coordinates having an origin placed at a center of said conductive case, X axis and Y axis that are placed on said bottom of said conductive case, and Z axis intersecting said bottom, said conductive case is symmetric with respect to ZX surface and ZY surface of said rectangular coordinates, and said feeding section is placed on Y axis of said rectangular coordinates.

20. The antenna according to claim 19, wherein said internal conductor has a center at said origin.

21. The antenna according to claim 19, wherein said internal conductor is symmetric with respect to said ZX surface and ZY surface.

22. The antenna according to any one of claims 19 to 21, wherein said X axis is along a direction of radiating an electromagnetic wave.

23. An antenna comprising:

a conductive case having at least a single opening on an upper part, an internal conductor disposed in said case, and generally shaped like a letter "u", a letter "U", or an arc, and a feeding element connected to a feeding section disposed on a bottom of said conductive case, wherein said internal conductor is connected to said bottom of said conductive case, and at least one or more directivity control conductors, and when using rectangular coordinates having an origin placed at the center of said conductive case, X axis and Y axis that are placed on said bottom of said conductive case, and Z axis intersecting said bottom, said directivity control conductors are placed so as to be symmetric with respect to ZY surface of said rectangular coordinates.

24. The antenna according to claim 23, wherein said directivity control conductors are placed so as to be symmetric with respect to ZX surface of said rectangular coordinates.

25. The antenna according to any one of claims 11 to 24, wherein at least one of said directivity control conductors is connected to said conductive case.

26. An antenna comprising:

a conductive case having at least a single opening on an upper part, an internal conductor disposed in said case, and generally shaped like a letter "u", and letter "U", or an arc, and a feeding element connected to a feeding section disposed on a bottom of said conductive case, wherein said internal conductor is connected to said bottom of said conductive case, and said internal conductor is connected to said conductive case via a coil.

* * * * *

UNITED STATES PATENT AND TRADEMARK OFFICE

CERTIFICATE OF CORRECTION

PATENT NO. : 6,680,712 B2
DATED : January 20, 2004
INVENTOR(S) : Yamamoto et al.

It is certified that error appears in the above-identified patent and that said Letters Patent is hereby corrected as shown below:

Title page,
Item [54] Title, "ANTENNA HAVING A CONDUCTIVE CASE WITH AN OPENING" should read -- AN ANTENNA HAVING A CONDUCTIVE CASE WITH AN OPENING --.
Item [56] References Cited, U.S. PATENT DOCUMENTS, "3,534,376 10/1970 Web" should read -- 3,534,376 10/1970 Webb --.
Insert -- OTHER PUBLICATIONS
European Search Report corresponding to application no. EP 02 00 2269 dated 03/28/02 --.

Signed and Sealed this

Twenty-seventh Day of July, 2004

JON W. DUDAS
*Acting Director of the United States Patent and Trademark Office*